US007499663B2

(12) United States Patent
Sato et al.

(10) Patent No.: US 7,499,663 B2
(45) Date of Patent: Mar. 3, 2009

(54) ELECTROPHOTOGRAPHIC IMAGE FORMING APPARATUS AND PROCESS CARTRIDGE

(75) Inventors: Masaaki Sato, Suntoh-gun (JP); Kazuo Chadani, Suntoh-gun (JP); Shigeo Miyabe, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/127,501

(22) Filed: May 27, 2008

(65) Prior Publication Data

US 2008/0240773 A1 Oct. 2, 2008

Related U.S. Application Data

(62) Division of application No. 11/174,562, filed on Jul. 6, 2005, now abandoned.

(30) Foreign Application Priority Data

Jul. 6, 2004 (JP) ..... 2004-198915
Jul. 22, 2004 (JP) ..... 2004-214215

(51) Int. Cl.
*G03G 15/08* (2006.01)

(52) U.S. Cl. ..... 399/106

(58) Field of Classification Search ..... 399/103, 399/106

See application file for complete search history.

(56) References Cited

U.S. PATENT DOCUMENTS

| | | | | |
|---|---|---|---|---|
| 5,640,650 | A | 6/1997 | Watanabe et al. | 399/117 |
| 5,839,028 | A | 11/1998 | Nomura et al. | 399/109 |
| 5,870,654 | A | 2/1999 | Sato et al. | 399/109 |
| 5,878,309 | A | 3/1999 | Nomura et al. | 399/111 |
| 5,878,310 | A | 3/1999 | Noda et al. | 399/117 |
| 5,940,658 | A | 8/1999 | Yokoi et al. | 399/119 |
| 5,974,288 | A | 10/1999 | Sato | 399/119 |
| 6,029,031 | A | 2/2000 | Yokomori et al. | 399/109 |
| 6,072,968 | A | 6/2000 | Nomura et al. | 399/113 |
| 6,104,894 | A | 8/2000 | Sato et al. | 399/106 |
| 6,173,145 | B1 | 1/2001 | Chadani et al. | 399/265 |

(Continued)

FOREIGN PATENT DOCUMENTS

JP 2-39169 A 2/1990

(Continued)

*Primary Examiner*—David M Gray
*Assistant Examiner*—Bryan Ready
(74) *Attorney, Agent, or Firm*—Fitzpatrick, Cella, Harper & Scinto

(57) ABSTRACT

An electrophotographic image forming apparatus for forming an image on a recording material, to which a process cartridge is detachably mountable, the apparatus, includes (a) a plurality of mounting portions for detachably mounting process cartridges, respectively, the process cartridges each including, an electrophotographic photosensitive drum, a developing roller for developing an electrostatic latent image formed on the electrophotographic photosensitive drum, a developer accommodating portion for accommodating a developer for use by the developing roller to develop the electrostatic latent image, a developer supply opening for supplying the developer to the developing roller from the developer accommodating portion, a sealing member for unsealably sealing the developer supply opening, and unsealing means for unsealing the developer supply opening by removing the sealing member from the developer supply opening; (b) a motor; and (c) driving force transmitting means for selectively transmitting a driving force from the motor to the unsealing means to unseal the developer supply openings of the process cartridges mounted to the mounting portions.

5 Claims, 23 Drawing Sheets

U.S. PATENT DOCUMENTS

| | | | | |
|---|---|---|---|---|
| 6,178,302 | B1 | 1/2001 | Nagashima et al. | 399/106 |
| 6,205,305 | B1 | 3/2001 | Suzuki et al. | 399/106 |
| 6,215,969 | B1 | 4/2001 | Nomura et al. | 399/111 |
| 6,282,390 | B1 | 8/2001 | Miyabe et al. | 399/111 |
| 6,301,457 | B1 | 10/2001 | Chadani et al. | 399/167 |
| 6,351,620 | B1 | 2/2002 | Miyabe et al. | 399/111 |
| 6,473,585 | B2 | 10/2002 | Abe et al. | 399/254 |
| 6,496,667 | B2 | 12/2002 | Shiratori et al. | 399/103 |
| 6,512,903 | B2 | 1/2003 | Chadani | 399/106 |
| 6,519,431 | B1 | 2/2003 | Toba et al. | 399/111 |
| 6,542,706 | B2 | 4/2003 | Toba et al. | 399/111 |
| 6,560,422 | B2 | 5/2003 | Kanno et al. | 399/106 |
| 6,603,939 | B1 | 8/2003 | Toba et al. | 399/103 |
| 6,640,066 | B2 | 10/2003 | Sato | 399/106 |
| 6,671,474 | B2 | 12/2003 | Chadani | 399/106 |
| 6,735,403 | B2 | 5/2004 | Kanno et al. | 399/103 |
| 6,795,666 | B2 | 9/2004 | Miyabe et al. | 399/109 |
| 6,898,399 | B2 | 5/2005 | Morioka et al. | 399/167 |
| 6,931,226 | B2 | 8/2005 | Chadani et al. | 399/109 |
| 2005/0053393 | A1 | 3/2005 | Harada et al. | 399/106 |
| 2005/0176299 | A1 | 8/2005 | Chadani et al. | 439/607 |
| 2005/0220480 | A1 | 10/2005 | Miyabe et al. | 399/111 |
| 2005/0238387 | A1 | 10/2005 | Ueno et al. | 399/117 |
| 2005/0244188 | A1 | 11/2005 | Sato et al. | 399/114 |

FOREIGN PATENT DOCUMENTS

| | | | |
|---|---|---|---|
| JP | 2-110584 | A | 4/1990 |
| JP | 9-96937 | | 4/1997 |
| JP | 9-114352 | A | 5/1997 |
| JP | 2001-188457 | A | 7/2001 |
| JP | 2001-201914 | A | 7/2001 |
| JP | 2001-281996 | A | 10/2001 |
| JP | 2002-6609 | A | 1/2002 |
| JP | 2002-23476 | A | 1/2002 |

(a)

ELECTROPHOTOGRAPHIC IMAGE FORMING APPARATUS AND PROCESS CARTRIDGE

This is a divisional of U.S. patent application Ser. No. 11/174,562, filed Jul. 6, 2005, pending.

FIELD OF THE INVENTION AND RELATED ART

The present invention relates to an electrophotographic image forming apparatus and a process cartridge.

An electrophotographic image forming apparatus of a process cartridge type is known in which an image is formed on a recording material through an electrophotographic image forming process. In the process cartridge type, an electrophotographic photosensitive member and process means actable on the electrophotographic photosensitive member is formed as a unit which is detachably mountable to a main assembly of the image forming apparatus. The process cartridge type is advantageous in that maintenance operation of the apparatus can be performed by the user without relying on a serviceman. Therefore, the operationality of the apparatus can be remarkably improved. The process cartridge type is widely used in the field of electrophotographic image forming apparatus.

A developing cartridge is a cartridge containing as a unit a developing roller and a developer accommodating portion for containing the developer for developing an electrostatic latent image formed on the electrophotographic photosensitive drum of the developing roller. The developing cartridge is detachably mountable to the main assembly of the electrophotographic image forming apparatus (developing cartridge type).

In such process cartridge and developing cartridge, a developer supply opening provided in the developer accommodating portion is sealed by a sealing member. Thus, before beginning of use, the developer is prevented from being supplied to the developing roller. When the cartridges are used, the sealing member is removed to unseal the supply opening. By doing so, the developer starts to be supplied to the developing roller from the developer accommodating portion.

It is known that sealing member is automatically removed from the supply opening by a driving force from the motor provided in the main assembly of the image forming apparatus. That is, the unsealing unsealing of the supply opening is known (Japanese Laid-open Patent Application Hei 9-114352).

On the other hand, a provision of a spacer member between the surface of the photosensitive drum and the charging member is known (Japanese Laid-open Patent Application Hei 2-3916 and Japanese Laid-open Patent Application 2001-201914).

SUMMARY OF THE INVENTION

The present invention provides a further improvement.

Accordingly, it is a principal object of the present invention to provide a color electrophotographic image forming apparatus to which a plurality of cartridges (developing cartridge and/or process cartridge) are mountable, wherein the sealing members of the cartridges can be automatically removed from the developer supply opening.

It is another object of the present invention to provide a color electrophotographic image forming apparatus to which a plurality of cartridges (developing cartridge and/or process cartridge) are mountable, wherein the sealing members of the cartridges can be easily removed from the developer supply opening without cumbersome operation by the operator.

It is a further object of the present invention to provide a color electrophotographic image forming apparatus to which a plurality of cartridges (developing cartridge and/or process cartridge) are mountable, wherein the sealing members of the cartridges can be automatically removed from the developer supply opening, without upsizing or the apparatus.

It is a further object of the present invention to provide a color electrophotographic image forming apparatus to which a plurality of cartridges (developing cartridge and/or process cartridge) are mountable, wherein the sealing members of the cartridges can be automatically removed from the developer supply opening using a single motor.

It is a further object of the present invention to provide a color electrophotographic image forming apparatus to which a plurality of cartridges (developing cartridge and/or process cartridge) are mountable, wherein the sealing members of the cartridges can be removed from the developer supply opening by selectively transmitting the driving force to the unsealing means.

It is a further object of the present invention to provide a *.

It is a further object of the present invention to provide a process cartridge and an electrophotographic image forming apparatus wherein the electrophotographic photosensitive drum and a process means which are forcedly kept out of contact to each other can be automatically brought into contact to each other.

It is a further object of the present invention to provide a process cartridge and an electrophotographic image forming apparatus wherein the electrophotographic photosensitive drum and a process means which are forcedly kept out of contact to each other can be brought into contact to each other without necessity for the operator to manipulate for the release of the forced separation.

It is a further object of the present invention to provide a process cartridge and an electrophotographic image forming apparatus the electrophotographic photosensitive drum and a process means which are forcedly kept out of contact to each other can be brought into contact to each other in interrelation with an unsealing operation for the developer supply opening.

It is a further object of the present invention to provide a process cartridge and an electrophotographic image forming apparatus the electrophotographic photosensitive drum and a process means which are forcedly kept out of contact to each other can be brought into contact to each other, with a simple structure.

It is a further object of the present invention to provide a *.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, a color electrophotographic image forming apparatus according to an embodiment of the present invention will be described. In this embodiment, is a color electrophotographic image forming apparatus wherein four process cartridges are mountable to respective mounting portions, and a color image is formed on a recording material.

[General Arrangement of Color Electronic Image Forming Apparatus].

Figure 1:
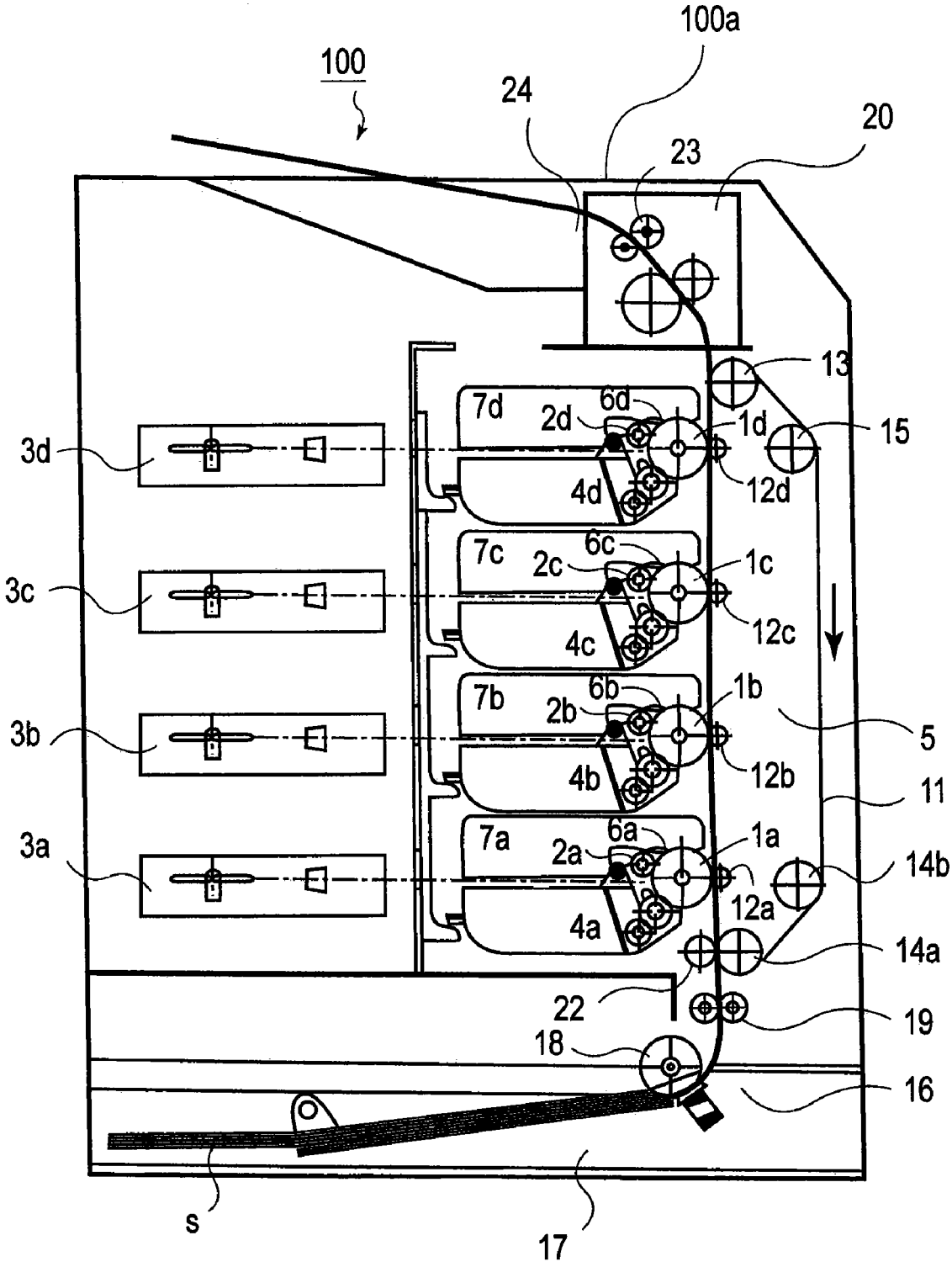
FIG. 1 is a longitudinal sectional view illustrating a schematic structure of an image forming apparatus according to a first embodiment of the present invention.

The description will be made as to the general arrangement of the image forming apparatus. FIG. 1 is a sectional view of a color laser beam printer according to this embodiment of the present invention.

As shown in FIG. 1, the electrophotographic image forming apparatus 100 in this embodiment comprises four image forming stations and feeding means for feeding the recording material to the image forming stations. Four image forming stations comprises electrophotographic photosensitive drums (photosensitive drums) for yellow color (Y), magenta color (M), cyan color (C) and black color (K) image formations, respectively, and the photosensitive drums are rotatable at a constant speed.

The photosensitive drums 1 (1*a*, 1*b*, 1*c*, 1*d*) of the image forming apparatus 100 which are arranged in parallel with each other in the vertical direction. The photosensitive drum 1 is rotatable in the couterclockwise in the Figure by driving means (unshown). Around the respective photosensitive drum 1, there are provided charging means 2 (2*a*, 2*b*, 2*c*, 2*d*) which are one of the process means, scanner units 3 (3*a*, 3*b*, 3*c*, 3*d*), developing units 4 (4*a*, 4*b*, 4*c*, 4*d*) having developing means which are one of the process means, electrostatic transferring devices 5, cleaning means 6 (6*a*, 6*b*, 6*c*, 6*d*) which are one of the process means, in the order named in the rotational direction of the photosensitive drum. The charging means 2 functions to uniformly charge the surface of the photosensitive drum 1. The scanner unit 3 functions to project a laser beam in accordance with image information. By doing so, an electrostatic latent image is formed on the photosensitive drum 1. The developing means functions to develop the latent image by depositing the developer on the electrostatic latent image. The transferring device 5 functions to transfer the developed image formed on the photosensitive drum 1 onto a recording material S (recording paper, OHP sheet or the like) which is being fed by a transfer belt 11. The cleaning means 6 functions to remove an untransferred residual developer remaining on the surface of the photosensitive drum 1 after the image transfer.

As shown in FIG. 1, the transfer belt 11 is provided in the image forming apparatus 100. The transfer belt 11 is provided opposed to the photosensitive drum 1 and moves while contacting to the photosensitive drum 1. The transfer belt 11 is supported vertically by four rollers 13, 14*a*, 14*b*, 15. The transfer belt 11 electrostatically attracts the recording material S on the outer surface thereof at the left traveling side in FIG. 1 to feed the recording material S to the photosensitive drum 1 and contact the recording material to the photosensitive drum 1. By this, the recording material S is fed to the transfer position by the transfer belt 11. At the transfer position, the developed image is transferred from the photosensitive drum 1 onto the recording material S.

Transfer rollers 12 (12*a*, 12*b*, 12*c*, 12*d*) are disposed inside the transfer belt 11 so as to oppose the respective photosensitive drum 1. Electric charge of the positive polarity is applied from the transfer roller 12 to the recording material S through the transfer belt 11. By the electric field provided by the charge, the developed image of the negative polarity on the photosensitive drum 1 is transferred onto the recording material S which is in contact with the photosensitive drum 1.

A feeding portion 16 functions to feed the recording material S into the image forming station. A cassette 17 therein accommodates a plurality of recording materials S. During the image forming operation, a feeding roller 18 (half-moon roller) and a pair of registration rollers 19 rotate in accordance with the process of image forming operation. The feeding portion 16 functions to feed the recording materials S one by one from the cassette 17. The leading end of the recording material S abuts to the nip of the registration rollers 19 and temporarily stops the recording material S. This is done in order to synchronize the rotation of the transfer belt 11 and the starting position of the image formation. Thereafter, the recording material S is fed to the transfer belt 11 by the pair of registration rollers 19.

The fixing portion 20 functions to fix, on the recording material S, the developed image of a plurality of colors having been transferred onto the recording material S. The recording material S having received the developed image thereon from the photosensitive drum 1 is subjected to heat and pressure when it passes through the fixing portion 20. By doing so, the developed image of the plurality of colors is fixed on the surface of the recording material S. The recording material S on which the developed image is fixed by the fixing portion 20 is discharged to an outside of the main assembly of the apparatus 100*a* through the discharging portion 24 by a pair of discharging rollers 23.

[General Arrangement of Process Cartridge].

Figure 2:
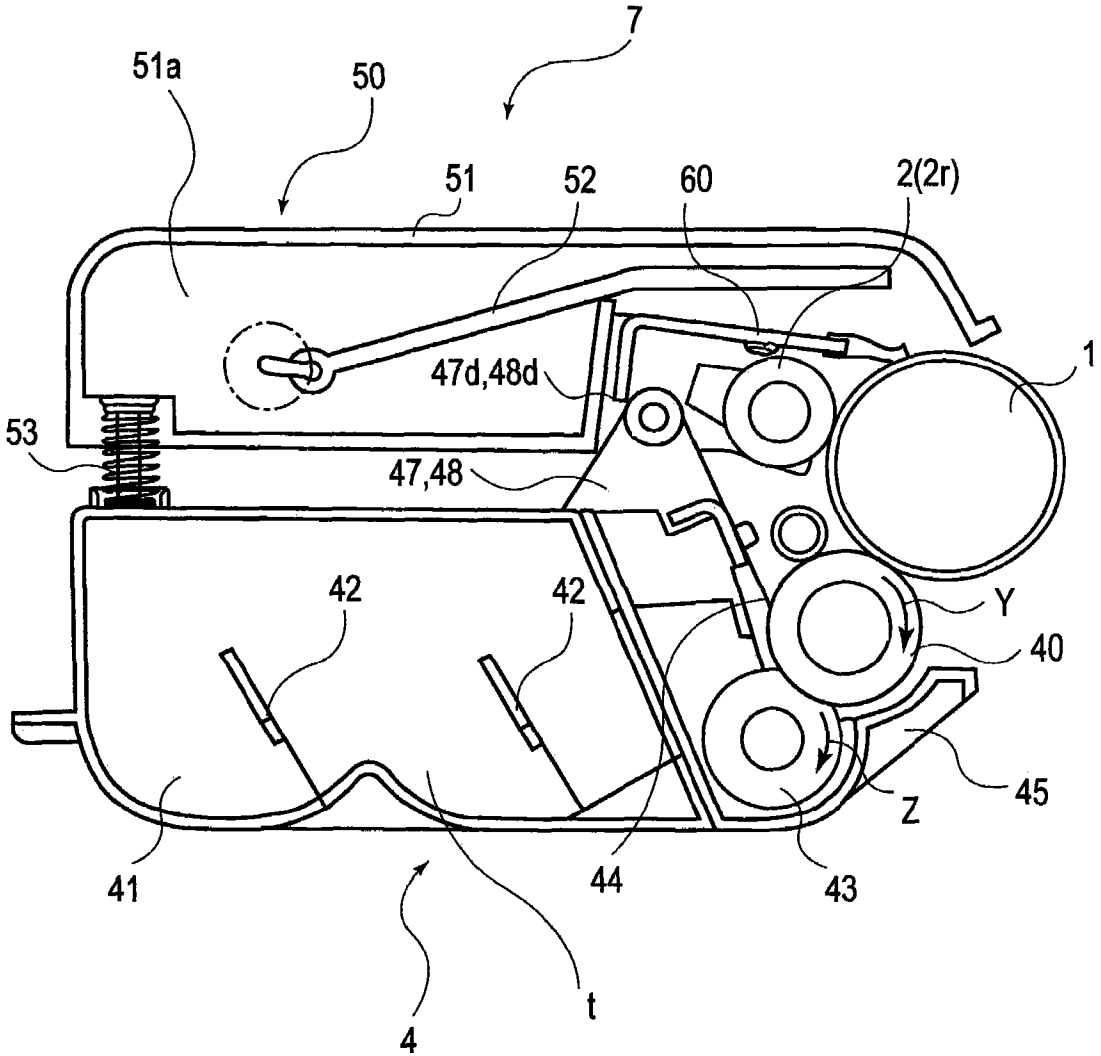
FIG. 2 is a sectional view of a process cartridge according to the first embodiment of the present invention.
Figure 3:
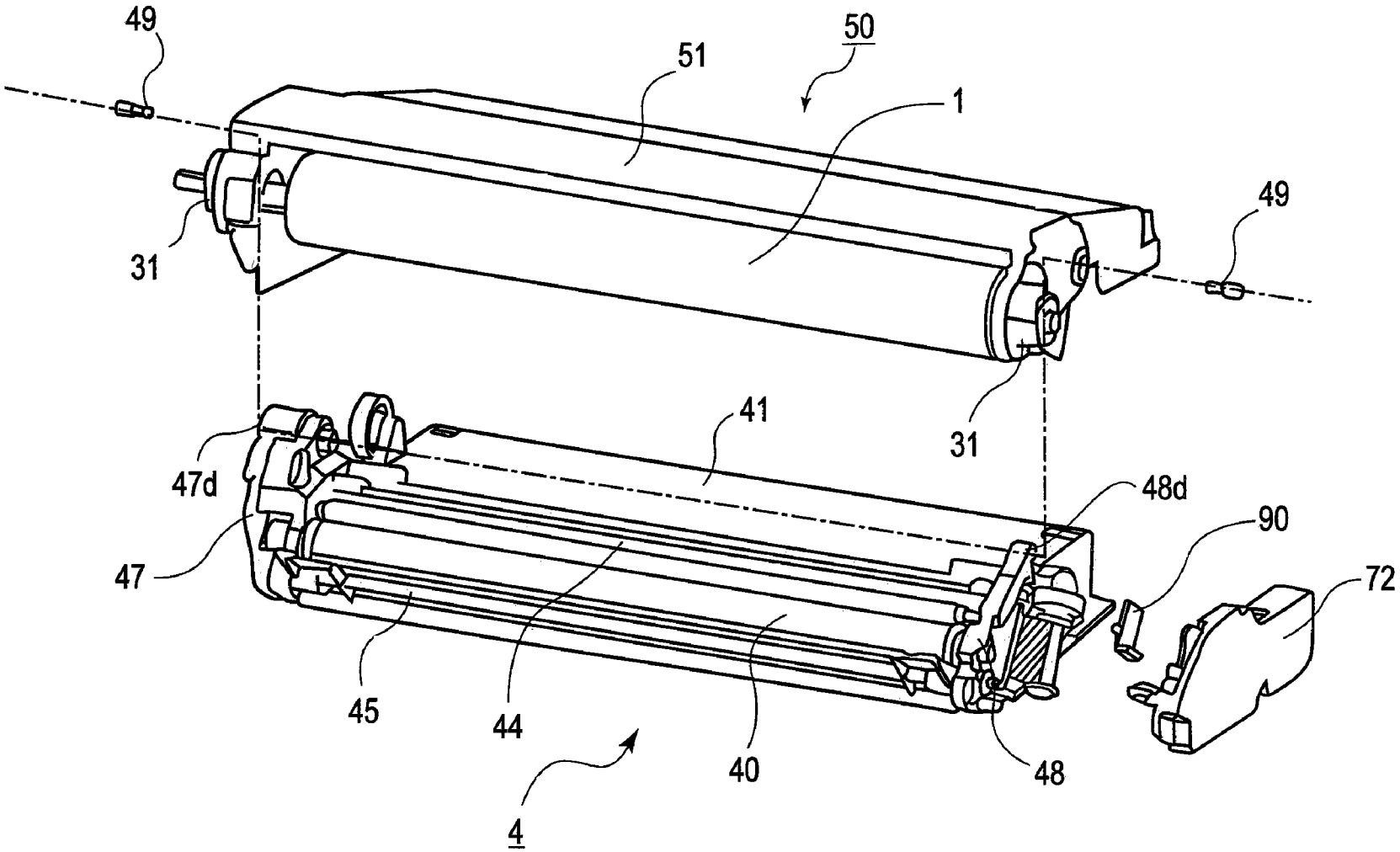
FIG. 3 is an exploded perspective view illustrating a process cartridge according to the first embodiment.

Referring to FIGS. 2 and 3, the description will be made as to the process cartridge 7. FIG. 2 is a sectional view of a cartridge 7 accommodating the developer. FIG. 3 is an exploded perspective view of the cartridge 7. The cartridges are yellow, magenta, cyan and black cartridges 7*a*, 7*b*, 7*c*, 7*d*, and they have a common structure.

As described hereinbefore, the photosensitive drum 1, the charging means 2, the developing unit 4 including the developing means, and the cleaning means 6 are unified into a cartridge (7*a*, 7*b*, 7*c*, 7*d*).

The cartridge 7 comprises a photosensitive drum unit 50 and a developing unit 4. Here, the drum unit 50 contains the photosensitive drum 1, the charging means 2 and the cleaning means 6. The developing unit 4 contains the developing means for developing the electrostatic latent image formed on the photosensitive drum 1.

The drum unit 50 includes a cleaning frame 51. The photosensitive drum 1 in addition rotatably mounted to the frame 51 through bearing 31. Around the photosensitive drum 1, there are provided primary charging means 2 and a cleaning blade 60. The primary charging means 2 uniformly charges the surface of the photosensitive drum 1. The blade 60 functions to remove the residual developer from the photosensitive drum 1. The residual developer removed from the surface of the photosensitive drum 1 by the blade 60 is sequentially fed into a developer chamber 51*a* provided behind the frame 51 by a developer feeding mechanism 52.

The photosensitive drum 1 comprising an aluminum cylinder and an organic photoconductive layer (OPC photosensitive material) on the outer surface thereof. The opposite ends of the photosensitive drum 1 is rotatably supported by supporting members in the form of bearings 31. A driving force is transmitted to one of the ends from a driving motor (unshown). By doing so, the photosensitive drum 1 is rotated in the couterclockwise.

As shown in FIG. 2, the charging means 2 is of a contact charging type. The charging means 2 of this embodiment is in the form of an electroconductive roller 2*r*. The charging roller 2*r* is contacted to the surface of the photosensitive drum 1. A charging bias voltage is applied to the charging roller 2*r* from the main assembly of the apparatus 100*a*. In this manner, the charging roller 2*r* uniformly charges the surface of the photosensitive drum 1.

The developing unit 4 comprises the developing roller 40, the developer container 41 (developer accommodating portion) accommodating the developer, and the developing device frame 45. The developing roller 40 rotates in the direction of an arrow Y while contacting to the photosensitive drum 1. The developing roller 40 is rotatably supported by the developing device frame 45 through the bearing members 47, 48. Around the developing roller 40, there are provided a developer supplying roller 43 and a developing blade 44. The supplying roller 43 rotates in the direction of an arrow Z while contacting the developing roller 40. In the developer container 41, a developer feeding mechanism 42 is provided. The feeding mechanism 42 stirs the developer in the developer container 41 and feeds the developer to the supplying roller 43. The yellow cartridge 7*a* accommodates the developer the of yellow color in the developer container 41. The magenta cartridge 7*b* accommodates the developer the of magenta color in the developer container 41. The cyan cartridge 7*c* accommodates the developer the of cyan color in the developer container 41. The black cartridge 7*d* accommodates the developer the of black color in the developer container 41.

The developing roller 40 is supplied with a developing bias from the main assembly of the apparatus 100*a* while contacting to the photosensitive drum 1. By this, the developing roller 40 develops the electrostatic latent image. The developing blade 44 regulates an amount of the developer applied on the developing roller 40.

In the contact developing system wherein the developing roller 40 is contacted to the photosensitive drum 1 during development as in this embodiment, the developing roller 40 has a surface of elastic member while the photosensitive drum 1 is rigid. The elastic material may be a solid rubber monolayer, a solid rubber layer coated with a resin material in consideration of charging application property to the developer, or the like.

As described hereinbefore, the cartridge 7 comprises the drum unit 50 and the developing unit 4. As shown in FIGS. 2 and 3, the developing unit 4 is swingably connected with the drum unit 50, and more particularly, it is supported by supporting shafts 49 which in turn are supported by supporting sleeves 47*d*, 48*d* which in turn are supported by the bearing members 47, 48 at the opposite ends, so as to be swingable relative to the drum unit 50. As described above, in the contact developing system as in this embodiment, it is necessary that developing roller 40 is contacted to the photosensitive drum 1 during development. To accomplish this, to the developing unit 4, an urging force is applied by an urging spring 53 to produce a rotation moment about the supporting shafts 49 so as to contact the developing roller 40 to the photosensitive drum 1.

Figure 4:
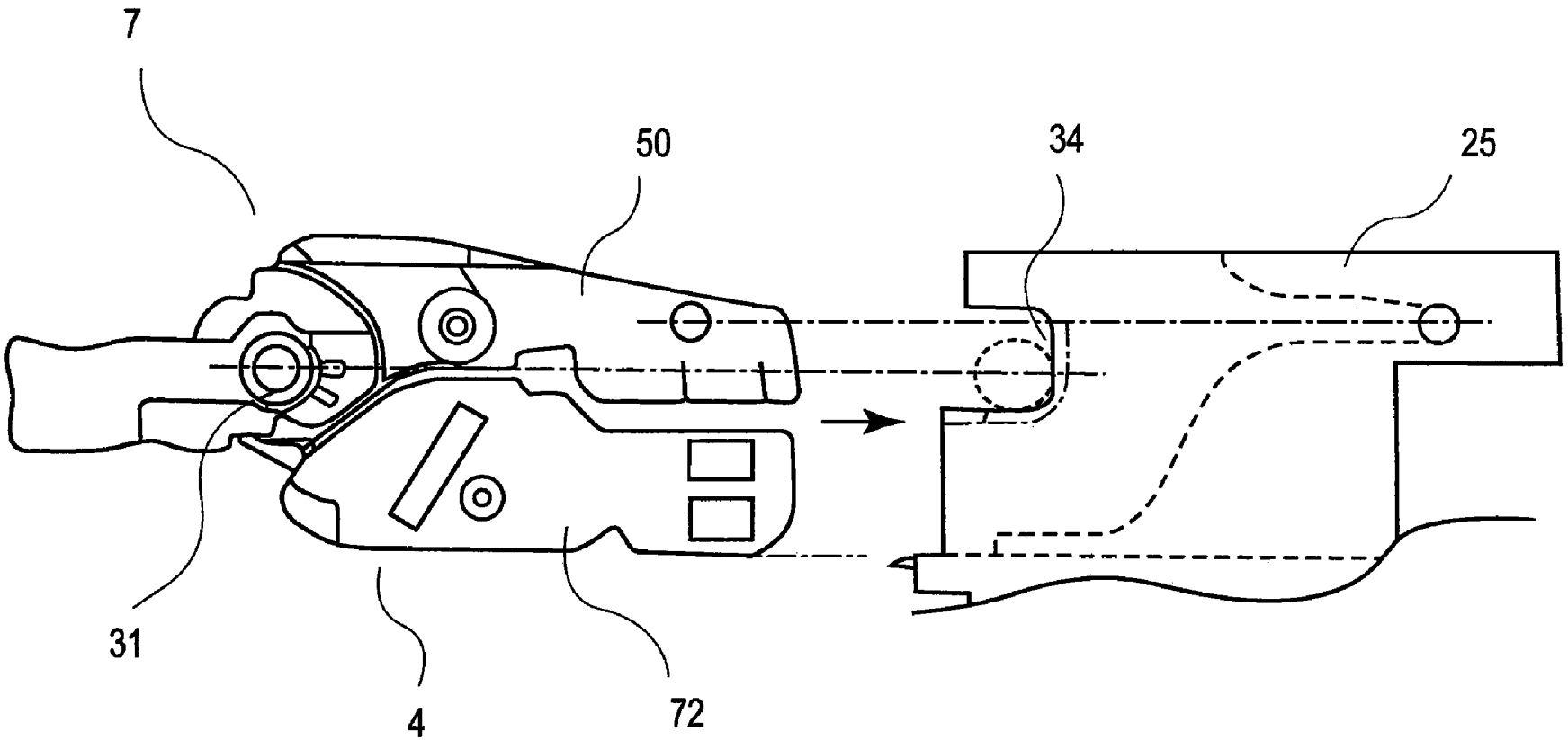
FIG. 4 is a partial sectional view illustrating mounting of the process cartridge to the main assembly of the image forming apparatus according to the first embodiment of the present invention.

As shown in FIGS. 3 and 4, a side cover 72 is provided outside the bearing member 48 of the developing unit 4. By the side surface of the photosensitive drum unit 50 and the side cover 72 of the developing unit 4, a side surface of the cartridge 7 is constituted.

[Mounting Portion of Process Cartridge].

The main assembly of the apparatus 100*a* has a plurality of mounting portions for demountably mounting the cartridges 7, respectively. The description will be made as to the mounting structure for mounting the cartridge 7 to the main assembly of the apparatus 100*a*. In the following descriptions, the longitudinal direction means an axial direction jx of the photosensitive drum 1, and a sectional direction is perpendicular to the rotational axis.

Figure 5:
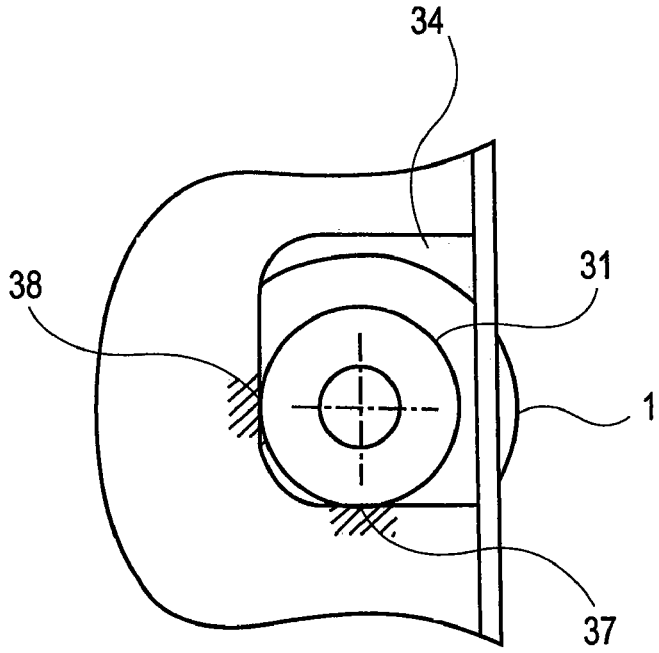
FIG. 5 is a partially sectional view illustrating a positioning portion for positioning the process cartridge to the image forming apparatus according to the first embodiment of the present invention.

As shown in FIG. 4, when the cartridge 7 is mounted to the main assembly of the apparatus 100*a*, the cartridge 7 is inserted into the main assembly along cartridge guides 25 provided in the main assembly of the apparatus 100*a* in the direction of the arrow. Thereafter, bearings 31 supporting the photosensitive drum 1 are inserted into the guide grooves 34. As shown in FIG. 5, the bearings 31 are urged to the abutment surfaces 37, 38 of the guide groove 34. Thus, the position of the cartridge 7 relative to the main assembly of the apparatus 100*a* is determined. On the other hand, the longitudinal direction of the cartridge 7 is roughly guided by the side surfaces of the cartridge 7 having the guiding members 25. Thereafter, by urging means (unshown) of the side surfaces of the main assembly of the apparatus 100*a*, the positioning portions of the side surfaces of the drum unit 50 are urged to predetermined positions of the main assembly of the apparatus 100*a*. By doing so, the positioning of the cartridge 7 is completed in the longitudinal direction.

Figure 6:
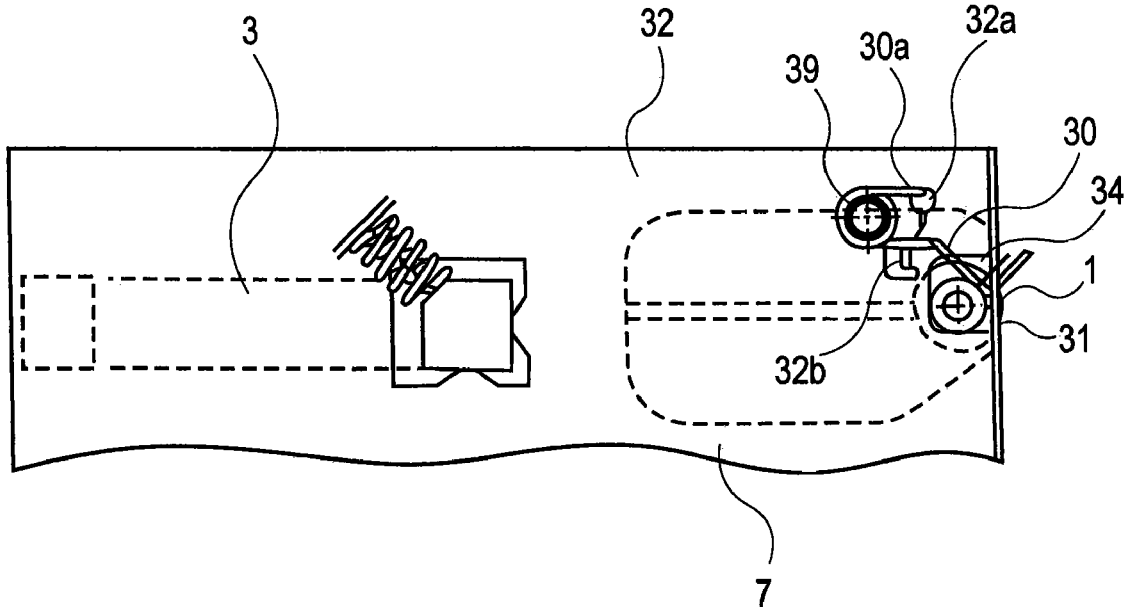
FIG. 6 is a sectional view of a positioning portion for positioning the process cartridge to the image forming apparatus according to first embodiment of the present invention.

The cartridge 7 is held in the sectional direction in the main assembly of the apparatus 100*a* as shown in FIG. 6. On the left and right plates 32, shafts 39 are clamped. A coil spring 30 is supported by the shaft 39. An end 30*a* of the spring 30 is locked by a hole 32*a* of a plate 32. When the cartridge 7 is not mounted, the spring 30 is limited in its rotation by a bent and erected portion 32*b* of the plate 32 (left and right). When the cartridge 7 is inserted, the spring 30 is rotated in the couter-clockwise direction against the spring forces. When the springs 30 ride over the bearings 31, they take the positions shown in FIG. 6. The spring 30 presses against the side surface of the cartridge 7 at approx. 1 kgf in the direction of the arrow, and positions the cartridge 7 relative to the main assembly of the apparatus 100*a* in the sectional direction.

[Developer Seal Removing Means].

In the cartridge 7, the developer supply port is sealed with a developer seal 46 (sealing member) so as to prevent leakage of the developer from the inside of the developer container 41 during transportation or the like. The seal 46 is removed upon the start of use of the cartridge 7. In the cartridge 7 of this embodiment, the seal is automatically removed by unsealing means which will be described hereinafter.

Figure 7:
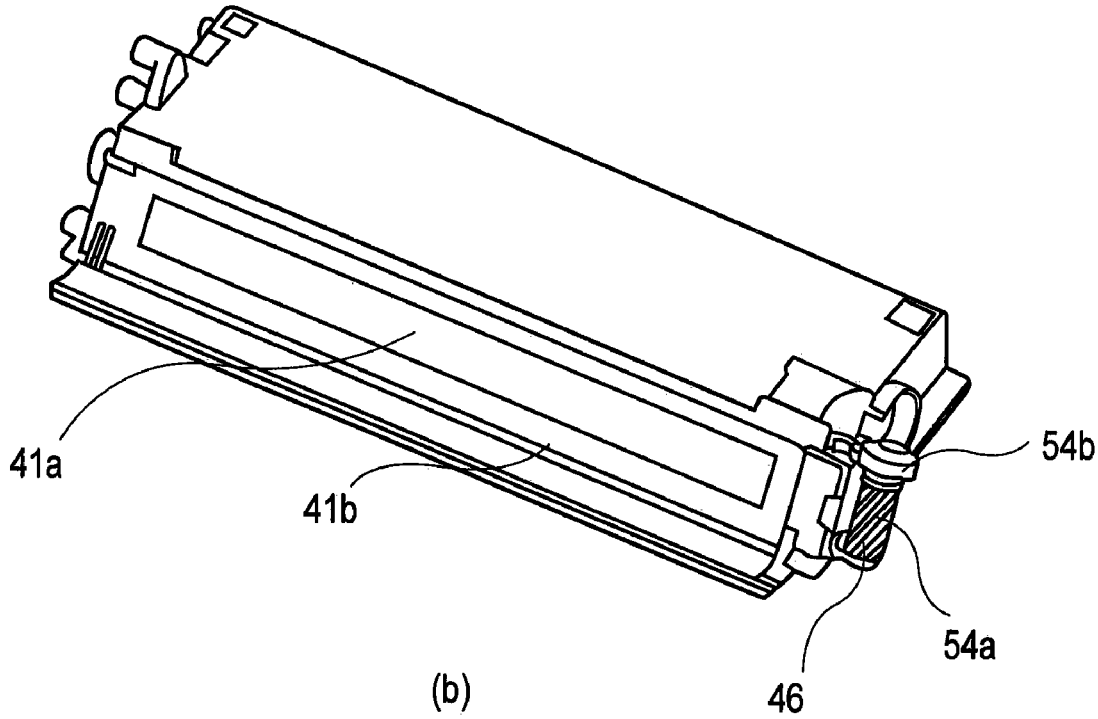
FIG. 7 is a schematic exploded perspective view of an opening of a developer container according to the first embodiment of the present invention.
Figure 7:
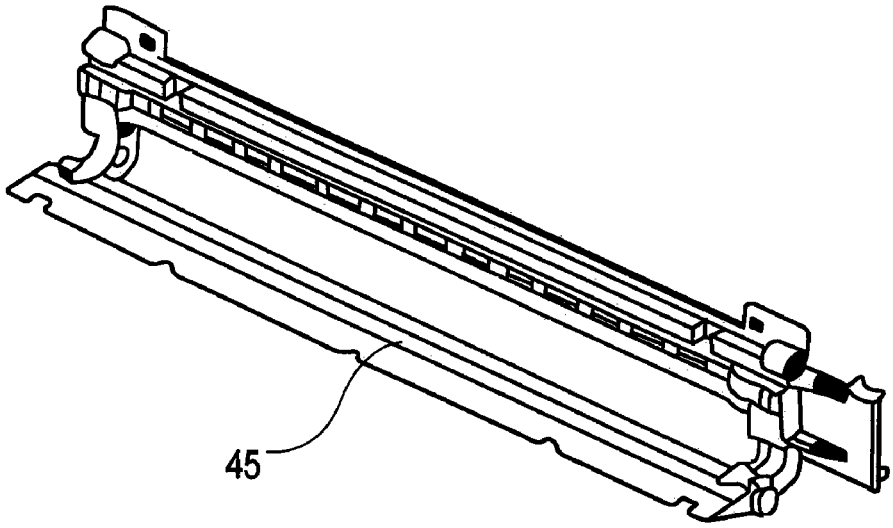

FIG. 7 illustrates the developer container 41 and the developing device frame 45. As shown in FIG. 7, the opening 41*a* (developer supply opening) is provided at the connecting portion between the developer container 41 and the developing device frame 45. The opening 41*a* functions to feed the developing device frame 45 out of the developer container 41. Around the opening 41*a*, there is provided a welding surface 41*b* on which the seal 46 (sealing member) which will be described hereinafter, is to be welded.

Figure 8:
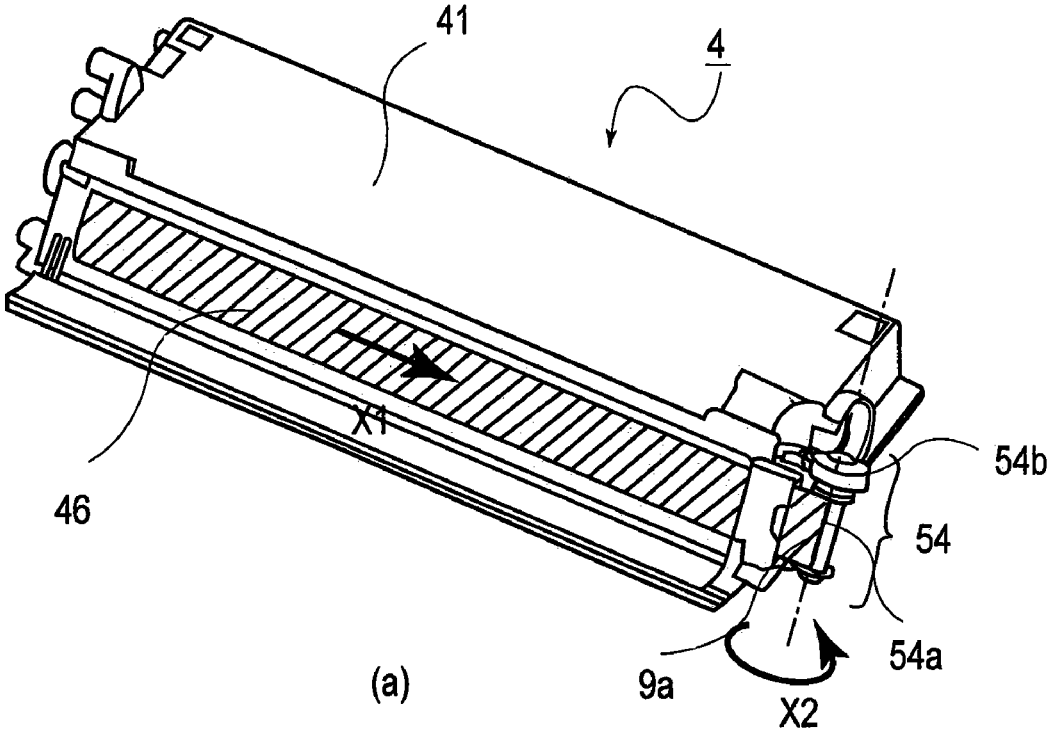
FIG. 8 illustrates winding-up removal of the developer seal according to do first embodiment of the present invention.
Figure 8:
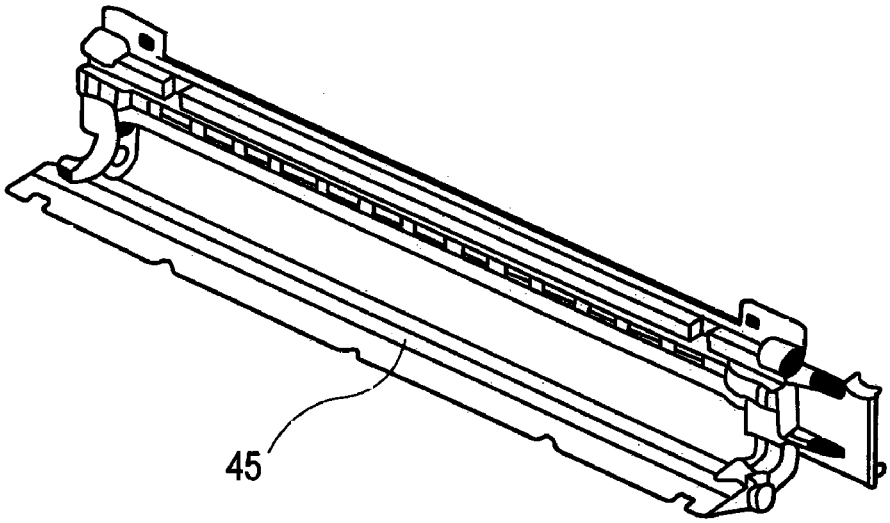

In FIG. 8, the seal 46 is mounted on the developing device frame 45 and the developer container 41 to seal the opening 41*a* of the developer container 41. The seal 46 is a sheet-like member, and seals the opening 41*a* of the developer container 41 (FIG. 7) by welding, bonding or the like on the welding surface 41*b*. By doing so, the opening 41*a* is sealed.

The seal 46 is folded back at one longitudinal end of 46*a* of the opening 41*a*. The other longitudinal end portion 9*a* is fixed on a winding-up member 54 which is the unsealing means. The winding-up member 54 comprises a winding-up portion 54*a* for winding the toner seal 46 up and a gear portion 54*b* for receiving a rotational driving force from the main assembly of the apparatus 100*a*. The leading end of the seal 46 is provided with a hole, which is hooked on a claw of the winding-up portion 54*a*. By doing so, the seal 46 is fixed on the winding-up member 54. The seal 46 is peeled off the opening 41*a* of the developer container 41 by pulling the end in the direction indicated by an arrow X1. The unsealing and separation of the seal 46 is carried out by rotating the winding-up member 54 in the direction indicated by an arrow X2. A driving force is transmitted to the gear portion 54*b* from the driving source provided in the main assembly of the apparatus 100*a*. This rotates the winding-up member 54.

The seal 46 may be of an easy peel type in which one sheet is folded back, or of a combination type in which a cover film for sealing the supply port 41*a* of the developer container 41 and a tear tape for tearing the cover film are combined. In this embodiment, either type is usable. With the type of the tear tape, the tear tape is wound up by the winding-up member 54.

At this time, as shown in FIG. 7, the toner seal 46 is wound on the winding-up portion 54*a* of the winding-up member 54. The overall shaft diameter of the winding-up member 54 changes by the amount corresponding to the seal.

[Notification Means and Notified Information Processing Means].

The cartridge 7 is provided with notification means for notifying to the main assembly of the apparatus whether the opening 41*a* is sealed by the seal 46 or unsealed. In this embodiment, the notification means includes a memory unit 67 mounted on the cartridge 7. Correspondingly, the main assembly of the apparatus 100*a* is provided with a memory control circuit as the notified information processing means.

The unit 67 has a non-volatile storing element. The unit 67 carries out data communication with the main assembly of the apparatus 100*a*. By doing so, data can be written in the unit 67 and can be read out therefrom.

The data communication is carried out in a non-contact manner, that is, by magnetic coupling between an antenna provision in the unit 67 and a reading/writing device provided in the main assembly of the apparatus 100*a*. When the cartridge 7 is mounted to the main assembly of the apparatus 100*a*, the antenna portion of the unit 67 and the reading/writing device of the main assembly of the apparatus 100*a* become close to each other. This enables communication between the antenna portion and the reading/writing device.

In the inside of the unit 67, a voltage source circuit is provided, and the DC voltage source to be used therein is supplied from the voltage source circuit. The voltage source circuit generates a DC voltage by rectifying the current generated in the antenna by the magnetic coupling between the two antennas. The information relating to the cartridge 7 is stored in the unit 67.

If the information is indicative of the sealed state of the opening 41*a* of the developer container 41 by the seal 46, the seal 46 is wound up to unseal the opening 41*a* using the driving force supplied from the main assembly of the apparatus 100*a*. By doing so, the opening 41*a* is opened. When the seal 46 is removed from the sealing position, and the opening 41*a* is opening, the information indicative of the open state of the opening 41*a* is stored in the unit 67.

[Unsealing Drive Transmitting Means for Developer Seal].

The image forming apparatus 100 of this embodiment is capable of receiving the cartridge 7. The apparatus 100 obtains the information from the unit 67, and transmits the driving force selectively to one of the winding-up shafts 54, the associated cartridge 7 of which has a seal 46 sealing the opening.

Figure 9:
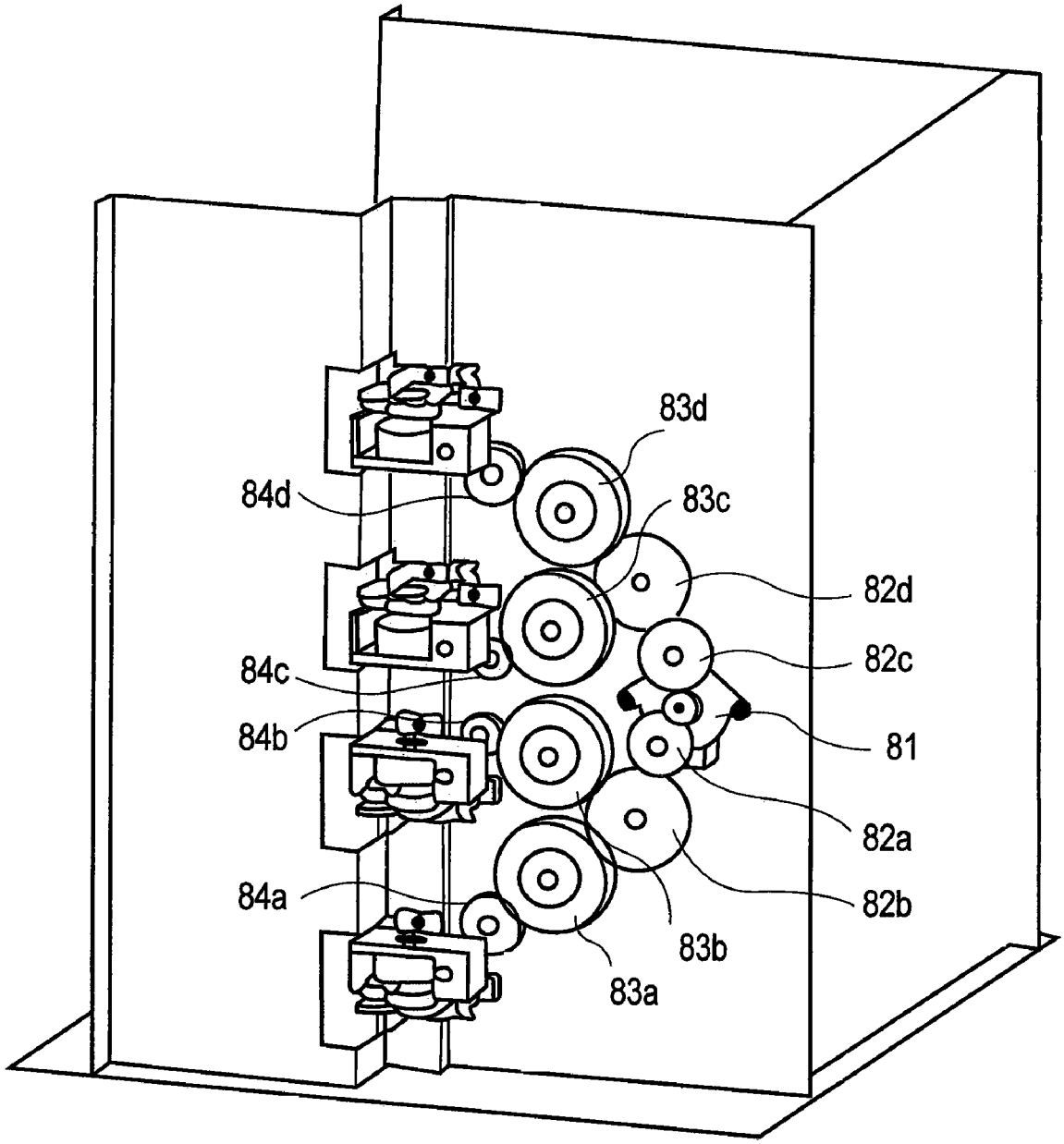
FIG. 9 illustrates a drive transmission to a developer seal winding-up shaft according to the first embodiment of the present invention.

The drive transmitting means to accomplish this is constituted as shown in FIG. 9. A driving force from the driving motor 81 which is a single driving source of the main assembly of the apparatus 100*a* (provided on one side frame) is transmittable to the gears 82*a*, 82*b* (one of gear trains). The driving force is transmittable to the other gear train including gears 82*c*, 82*d*. Through the gear trains 82*a*, 82*b*, 82*c*, 82*d*, the driving force is transmittable to four clutches 83 (83*a*, 83*b*, 83*c*, 83*d*) corresponding to four cartridge 7.

The clutches 83 are electromagnetic clutches, for example. The clutches 83 transmit the driving force to the downstream gears 84 (84*a*, 84*b*, 84*c*, 84*d*) by an engine controller 61 (which will be described hereinafter) provided in the image forming apparatus 100. Each of the gears 84 is further engaged with a warm gear, a warm wheel, a bevel gear and the like. In this manner, the driving force is transmitted to any one of the winding-up members 54 with the rotational direction matched with the winding-up member 54 of the cartridge 7.

By selectively actuating the four clutches 83, the driving force can be transmitted to all of the winding-up members 54 of the cartridges 7.

[Developer Seal Winding-Up System].

Figure 10:
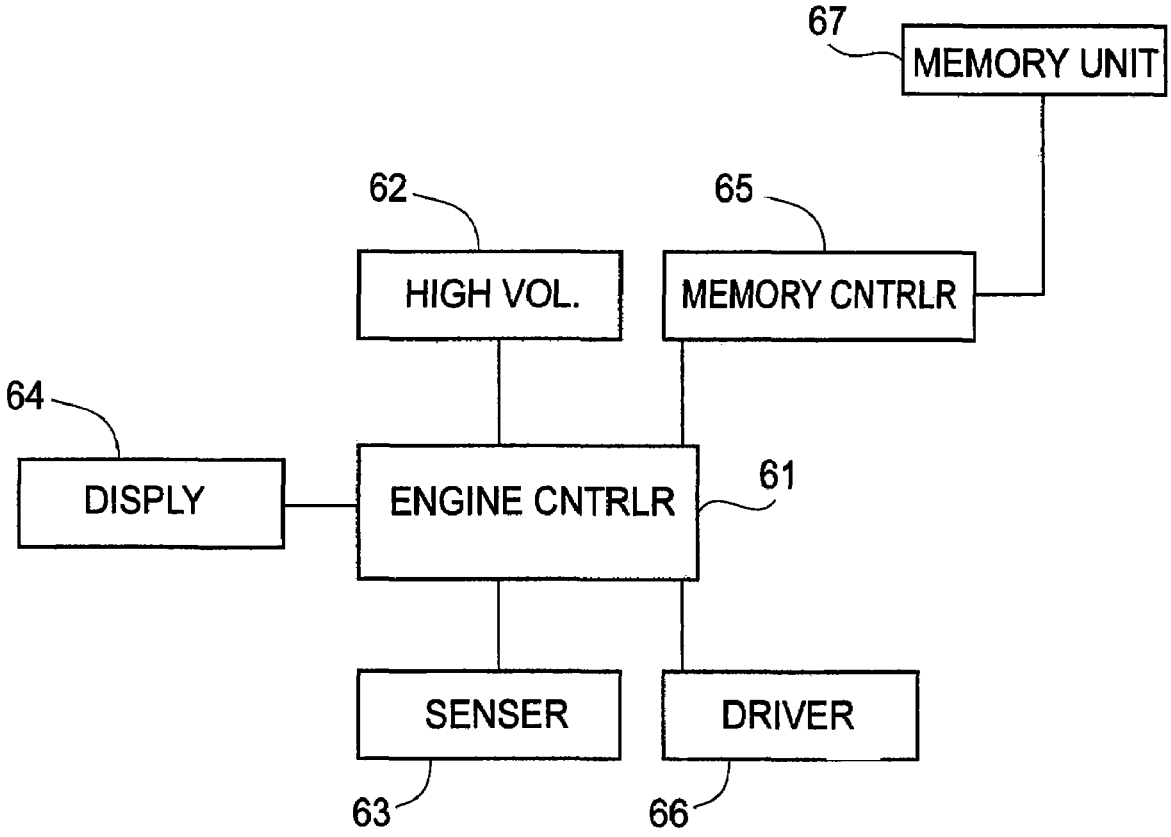
FIG. 10 is the block diagram of a control system used with the apparatus according to the first embodiment.

Referring to FIG. 10 which is a system block diagram, the description will be made as to the system structure for the selective winding-up of the seal 46.

In FIG. 10, designated by 61 is an engine controller for the system control of the entirety of the image forming apparatus. The engine controller 61 comprises an unshown central processing unit (CPU), and sequential the system processing of the image forming apparatus is carried out by the program stored in the central processing.

The controller 61 controls the high voltage source 62 and the driver 66 and displays the predetermined information on the display portion 64 in response to the detection signal from the sensor portion 63 and the input signal. In this manner, the controller 6 controls the image forming operation. In this embodiment, when the cartridge 7 is mounted to the main assembly of the apparatus 100*a*, the memory control circuit 65 becomes communicatable with the memory unit 67 of the cartridge 7. Then, the operation of removal of the seal 46 and the like in the cartridge 7 are controlled.

Figure 11:
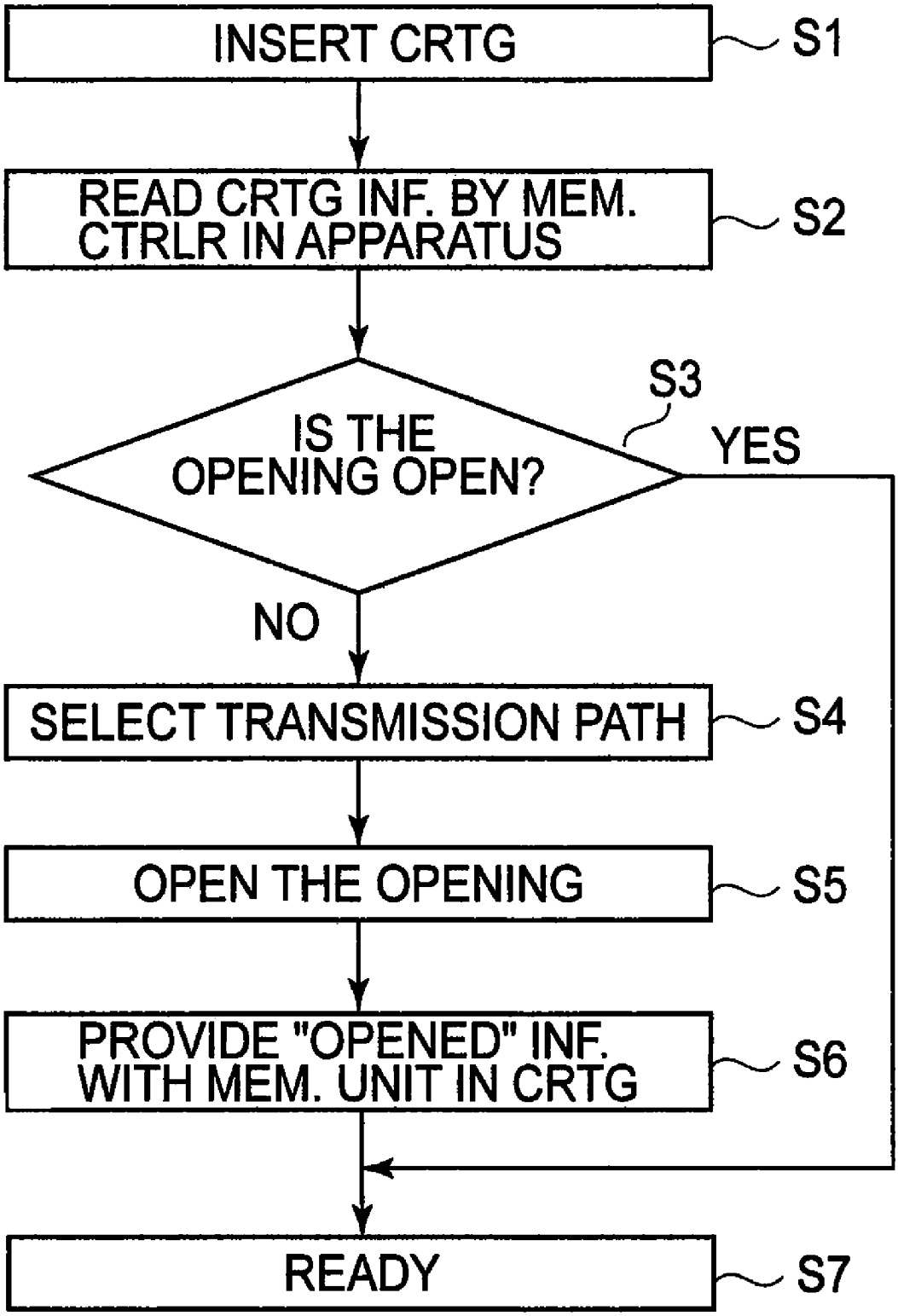
FIG. 11 is a flow chart showing winding-up removal process for the developer seal according to the first embodiment of the present invention.

FIG. 11 is a flow chart showing the removing process for the seal 46. More particularly, after the cartridge 7 of the embodiment is mounted to the main assembly of the apparatus 100*a* (step S1), the memory control circuit 65 (detecting means) for detecting the state of sealing of the opening 41*a* by the seal 46 reads the information from the memory unit 67 (step S2).

When there is a cartridge 7 in which the opening 41*a* is sealed by the seal 46 and therefore opening operation is necessary for the opening 41*a* thereof, the driving force transmission path is selected through the controller 61 so as to transmit the driving force from the main assembly of the apparatus 100*a* only to the winding-up member 54 of such a cartridge 7.

When, for example, only one cartridge 7*a* among the four cartridges 7*a*, 7*b*, 7*c*, 7*d*, is sealed by the seal 46, the driving motor 81 in FIG. 9 is driven. And, the clutch 83*a* corresponding to the cartridge 7*a* among the clutches 83*a*, 83*b*, 83*c*, 83*d* are operated (ON). By doing so, the driving force is transmitted to the winding-up member 54 of the cartridge 7*a*. And, the seal 46 is wound up and removed from the opening 41*a*. At this time, the other clutches 83*b*, 83*c*, 83*d* are not actuated (OFF). In other words, the driving force from the driving motor 81 is not transmitted to the winding-up members 54 of the other cartridges 7*b*, 7*c*, 7*d*.

By doing so, the opening 41*a* of the selected cartridge 7*a* is opened (step S5), and the information indicative of the state of open is stored in the unit 67 (step S6). Then, the image forming apparatus 100 is enabled, that is, the image formation can be performed (ready state, step S7).

In this embodiment, when there are a plurality of cartridges 7 in which the seals 46 are not removed, the driving force of the driving motor 81 is not simultaneously transmitted to the winding-up members 54 of the plurality of cartridges 7.

For example, when the detection of the information from the unit 67 represents that seals 46 are not yet removed in two cartridges 7*a*, 7*b* among the four cartridges 7*a*, 7*b*, 7*c*, 7*d* shown in FIG. 1, the driving motor 81 is actuated. By this, the clutch 83*a* associated with the cartridge 7*a* is actuated to transmit the driving force to the winding-up member 54 of the cartridge 7*a*. This winds up and remove the seal 46 from the opening in the cartridge 7*a*. At this time, no driving force is transmitted to the winding-up member 54 of the cartridge 7*b*.

When the removing operation for the seal 46 of the cartridge 7*a* is completed, the clutch 83*a* is deactuated (OFF). Then, the clutch 83*b* associated with the cartridge 7*b* is actuated (ON) to transmit the driving force to the winding-up member 54 of the cartridge 7*b* to wind up and remove the seal 46.

Therefore, when the seals 46 of all of the four cartridges 7*a*, 7*b*, 7*c*, 7*d* are bonded or welded, the driving force is sequentially transmitted one by one to the respective seal winding-up member 54, until all the sealed are removed.

In this embodiment, the opening 41*a* can be automatically opened using the driving source of the main assembly of the apparatus 100*a*, in this manner. Particularly, the memory unit 67 and the memory control circuit effect the transmission of the driving force selectively only to the cartridge 7 in which the opening 41*a* is sealed by the seal 46 in the state that cartridge 7 is set in the main assembly of the apparatus 100*a*.

When the seals 46 of a plurality of cartridges 7 are to be removed, they are subjected to the unsealing operation one by one by a single driving motor 81. For this reason, the driving motor 81 may be of small size, and the provision of the driving motor 81 does not lead to increase in cost or upsizing.

Second Embodiment

Figure 12:
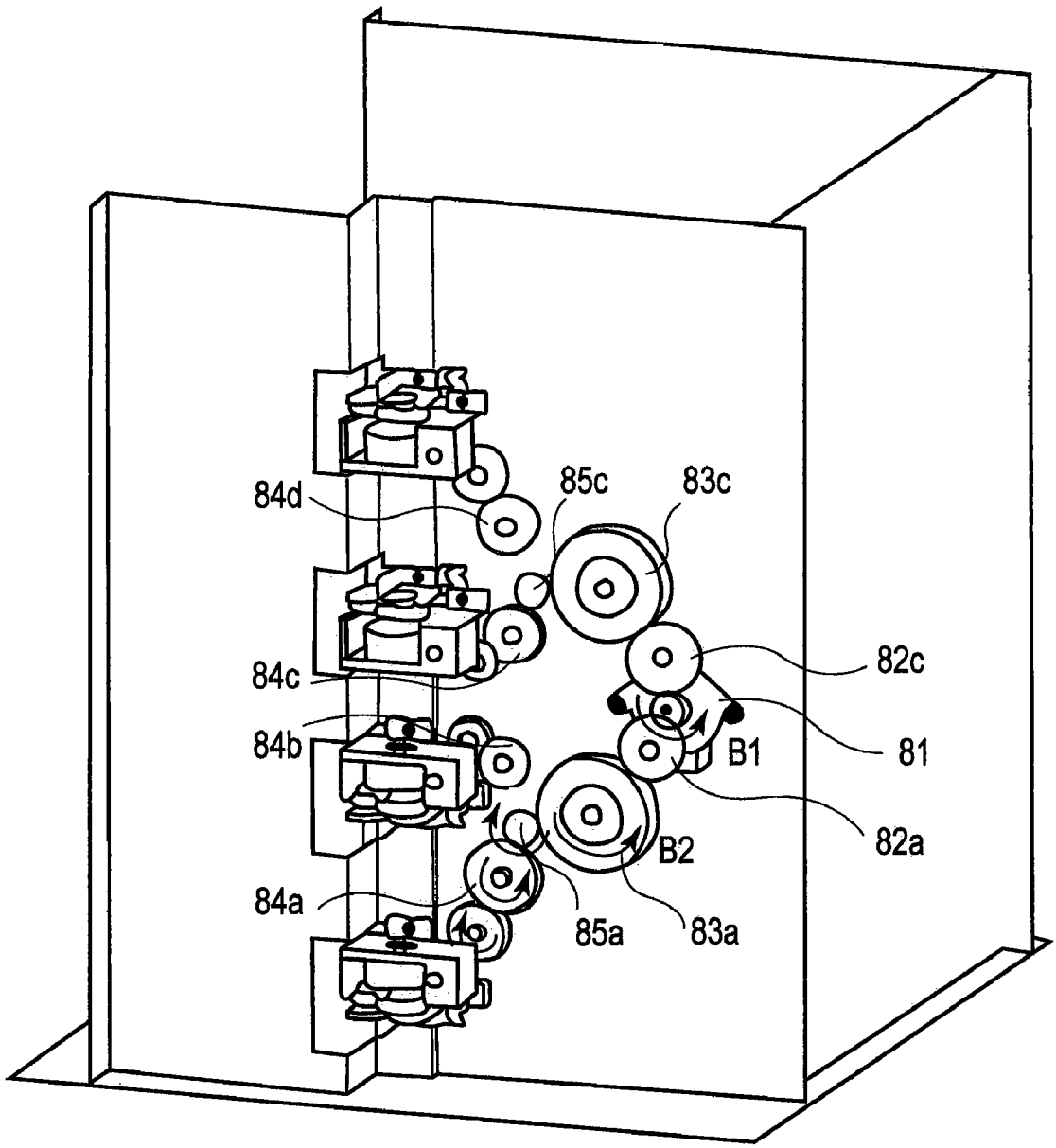
FIG. 12 illustrates a drive transmission to a developer seal winding-up shaft according to a second embodiment of the present invention.

Referring to FIG. 12, the description will be made as to a second embodiment of the present invention. The same reference numerals as with the first embodiment are assigned to the elements having the corresponding functions, and the detailed descriptions for such elements are omitted for simplicity.

FIG. 12 illustrates a driving force transmission to a winding-up member 54 according to the second embodiment. The driving force from the driving motor 81 provided in the main assembly of the apparatus 100*a* is transmitted to the clutches 83*a*, 83*c* through the gear 82*a* and the gear 82*c*. The clutch 83*a*, 83*c* are electromagnetic clutches, for example. Similarly to the first embodiment described above, the clutches 83*a*, 83*c* are controlled by the controller 61 of the image forming apparatus 100 to transmit the driving force to downstream swingable gears 85*a*, 85*c* (clutch ON) or not to transmit the driving force (clutch OFF) but to idle.

The controller 61 effects its controlling operation in the following manner to transmit the driving force only to the winding-up member 54 of the cartridge 7 in which the opening 41*a* is sealed by the seal 46 when the cartridge 7 is inserted into the main assembly of the apparatus 100*a*. For example, in order to transmit the driving force only to the winding-up member 54 of the cartridge 7*a* in FIG. 1, the driving force is transmitted from the driving motor 81 only to the gear 84*a* in FIG. 12. To do this, the driving motor 81 is rotated in the direction indicated by an arrow B1. The clutch 83*a* is controlled by the controller 61 so as to transmit the driving force to the downstream or not to transmit the driving force to the downstream. Then, the clutch 83*a* rotates in the direction indicated by an arrow B2, and the downstream swingable gear 85*a* is brought into meshing engagement with the further downstream gear 84*a*. The swingable gear 85*a* is swingable about a pivot of the clutch 83*a* with the engagement with the clutch 83*a*, depending on the rotational direction of the driving motor 81. Thus, the clutch 83*a* is selectively engageable with the gear 84*a* or with the gear 84*b*.

Therefore, when the swingable gear 85*a* is engaged with the gear 84*a*, it is out of engagement with the gear 84*b* by retracting therefrom to disconnect the transmission of the driving force to the gear 84*b*. The gears 84*c*, 84*d* are not rotated because the transmission of the driving force is blocked by the upstream clutch 83*c*.

On the other hand, when the swingable gear 85*a* is to be engaged with the gear 84*b*, the driving motor 81 is rotated in the direction opposite the direction of the arrow B1 while the clutch 83*c* is OFF.

The same applies to the selective drive transmission to the gears 84*c*, 84*d*. The swingable gear 85*c* is swingable about a pivot of the clutch 83*c* with engagement with the clutch 83*c*. That is, the gear 84*c* and the gear 84*d* are selectively engageable. Therefore, by deactuating the clutch 83*a* (OFF) and actuating the clutch 83*c* (ON), the driving force can be transmitted selectively to the gear 84*c* or 84*d* by changing the rotational direction of the driving motor 81.

Thus, by the control of the rotational direction of the driving motor 81 using the controller 61 and by the driving force transmission control of the clutch, the driving force can be transmitted to any one of the cartridges 7. By doing so, the same advantageous effects as in the first embodiment can be provided, and the number of the clutches can be decreased by 2, thus simplifying the structure of the device.

Third Embodiment

Figure 13:
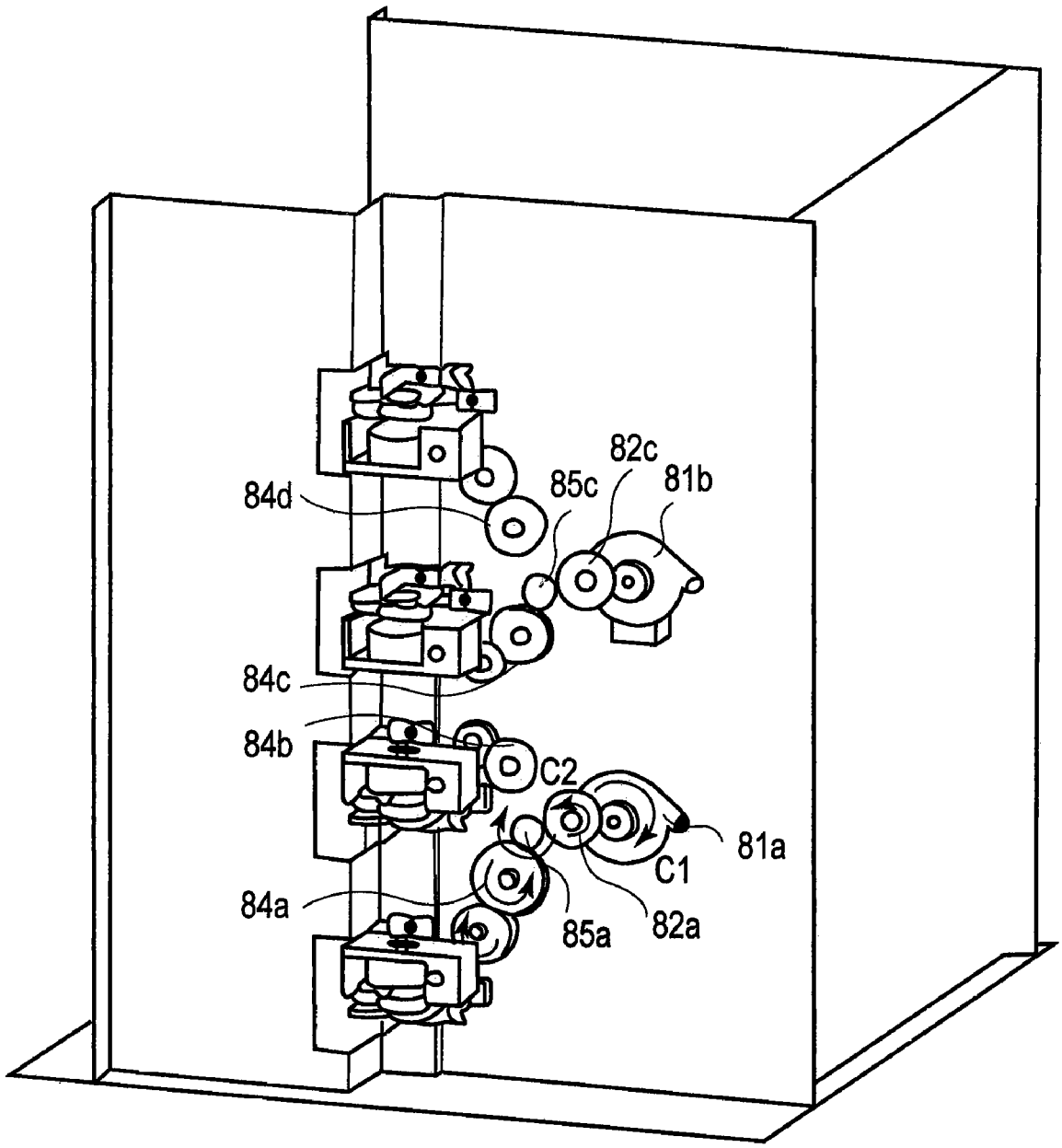
FIG. 13 illustrates a drive transmission to a developer seal winding-up shaft according to a third embodiment of the present invention.

Referring to FIG. 13, an apparatus according to a third embodiment of the present invention will be described. The same reference numerals as with the first embodiment are assigned to the elements having the corresponding functions, and the detailed descriptions for such elements are omitted for simplicity. The structures different from first embodiment will be described.

FIG. 13 illustrates driving force transmission to the winding-up member according to the third embodiment of the present invention, and two driving motors are used in this embodiment.

As shown in FIG. 13, the driving forces are transmitted to the gears 82*a*, 82*c* from the two driving motors 81*a*, 81*b* of the main assembly of the apparatus 100*a*. And, the driving forces are transmitted from the gears 82*a*, 82*c* to the swingable gears 85*a*, 85*c*. The swingable gears 85*a*, 85*c* swing about pivots of the gears 82*a*, 82*c* while keeping engagement with the gears 82*a*, 82*c* depending on the rotational directions of the driving motors 81*a*, 81*b*. Thus, the swingable gears 85*a*, 85*c* are selectively engaged with the gears 84*a*, 84*b* or gears 84*c*, 84*d*.

the controller 61 effects its control operation to transmit the driving force only to the cartridge 7 in which the opening 41*a* is sealed by the seal 46 when the cartridge 7 is inserted into the main assembly of the apparatus 100*a*.

For example, in order to transmit the driving force only to the winding-up shaft of the cartridge 7*a* in FIG. 1, the driving force is transmitted only to the gear 84*a* in FIG. 13 from the driving motor 81*a*. To do this, the driving motor 81*a* is rotated in the direction indicated by an arrow C1 in FIG. 13. Then, the gear 82*a* rotates in the direction indicated by an arrow C2, and the downstream swingable gear 85*a* is engaged with the further downstream gear 84*a*. In this manner, the driving force is transmitted from the driving motor 81*a* to the gear 84*a*. At this time, the swingable gear 85*a* is in a position retracted from the gear 84*b* to disconnect the transmission of the driving force to the gear 84*b*. And, the driving motor 81*b* is not operated.

When the driving force is to be transmitted to one of the gears 84*c*, 84*d*, the driving motor 81*b* is driven similarly to the foregoing case.

As described in the foregoing, the controller 61 controls rotations and stops of the driving motors 81*a*, 81*b*, and rotational directions of the driving motors 81*a*, 81*b*. By doing so, the driving force can be transmitted to any one of the cartridges 7. Therefore, the same advantageous effects as in the first embodiment are provided. In this embodiment, the number of the motors is two, but the clutch is not required. Therefore, the control structure is simple.

Fourth Embodiment

Referring to FIG. 14 through FIG. 18, the apparatus according to the fourth embodiment of the present invention will be described. The same reference numerals as with the first embodiment embodiment are assigned to the elements having the corresponding functions, and the detailed descriptions for such elements are omitted for simplicity. The description will be made as to the structures different from those in first embodiment.

Figure 14:
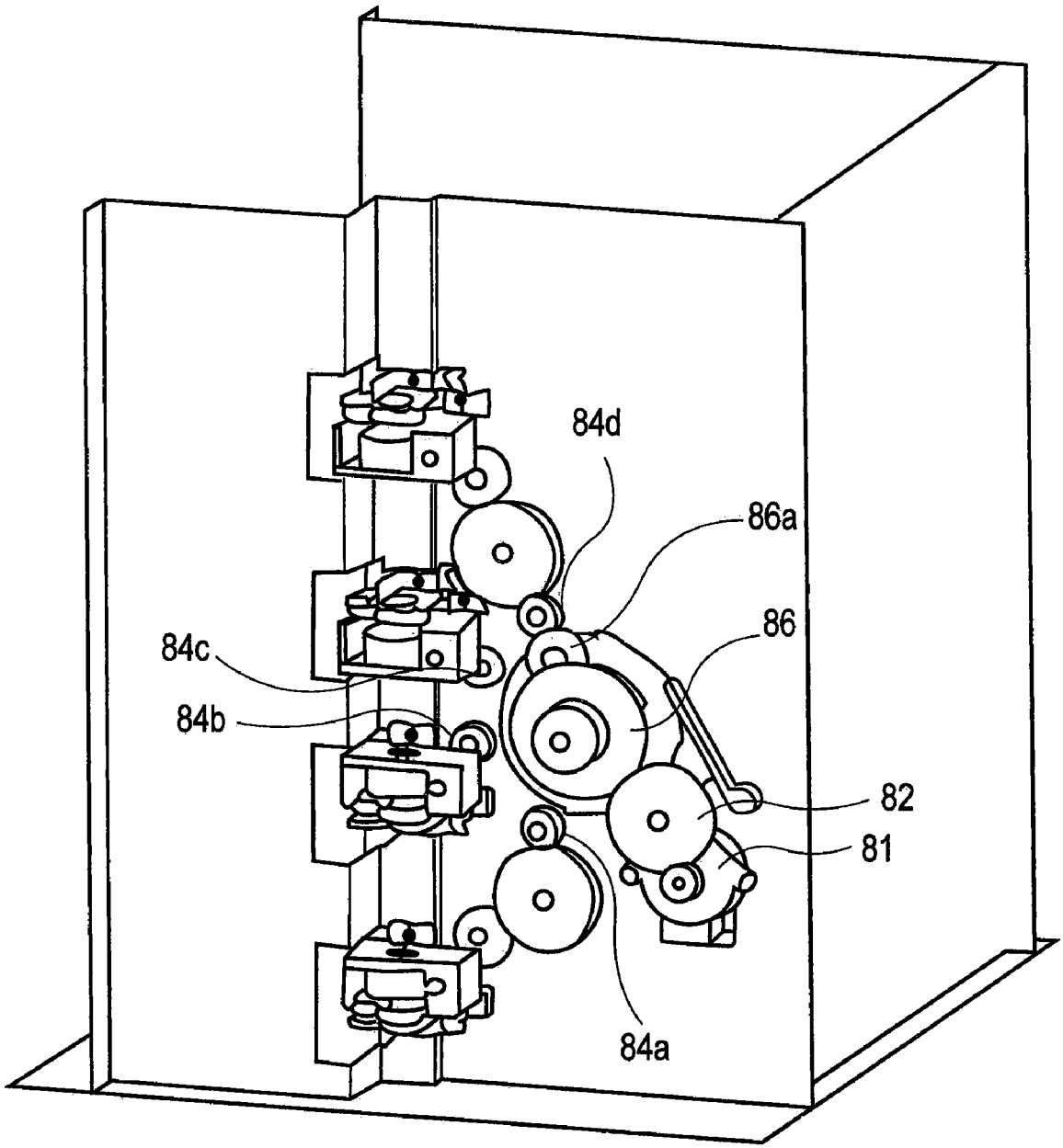
FIG. 14 illustrates a drive transmission to a developer seal winding-up shaft according to a fourth embodiment of the present invention.
Figure 15:
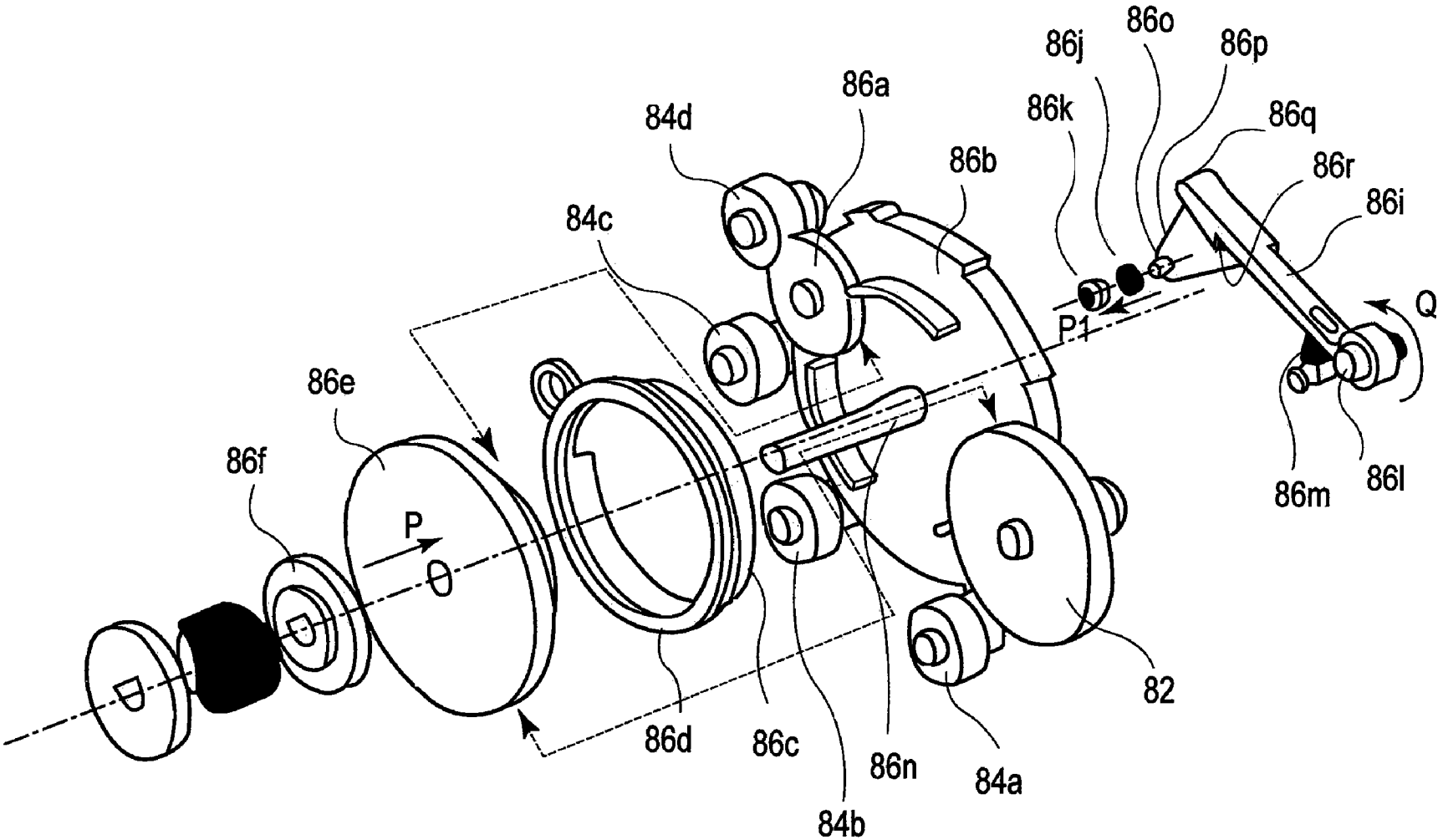
FIG. 15 illustrates the mechanical clutch according to the fourth embodiment of the present invention.

FIG. 14 illustrates driving force transmission to the winding-up member 54 according to the fourth embodiment. In this embodiment, the driving force from the driving motor 81 of the main assembly of the apparatus 100*a* is transmitted to a mechanical clutch 86 which will be described hereinafter, through a gear 82. By the planetary gear 86*a* of the clutch 86, one of the gears 84*a*, 84*b*, 84*c*, 84*d* to which the driving force is to be transmitted is selected, and the driving force is transmitted to the selected one.

Referring to FIG. 15 through FIG. 18, the description will be made as to the clutch 86 of this embodiment. The clutch 86 comprises a planetary gear 86*a*, a disk 86*b*, a felt 86*d*, a stepped gear 86*e* and a trigger 86*i*. The planetary gear 86*a* rotates about a shaft provided on the disk 86*b* and revolves about the shaft 86*n*. The disk 86*b*, the planetary gear retainer 86*c*, the felt 86*d* and the stepped gear 86*e* are rotatable about the shaft 86*n*. The felt 86*d* is fixed relative to the planetary gear retainer 86*c*. The planetary gear retainer 86*c* is fixed so as to rotate in synchronism with the disk 86*b* keeping the coaxiality with the disk.

One of the stepped gears 86*e* is normally in meshing engagement with the gear 82, and the other is normally in meshing engagement with planetary gear 86*a*. The stepped gear 86*e* is urged in the direction indicated by an arrow P in FIG. 15 by a pressure adjusting spring 86*g*. By this, the stepped gear 86*e* is normally urged to the felt 86*d* which is rotated in synchronism with the disk 86*b*. The driving force is transmitted from the driving motor 81 to the stepped gear 86*e* through the gear 82. Then, by the frictional force between the stepped gear 86*e* and the felt 86*d*, the disk 86*b*, the retainer 86*c*, the planetary-gear 86*a* rotate about the shaft 86*n* in synchronism with the stepped gear 86*e*. On the other hand, when an external force for stopping the disk 86*b* is applied, the stepped gear 86*e* rotations while sliding on the felt 86*d*. The planetary gear 86*a* does not revolve around the shaft 86*n*, but rotates about the shaft provided on the disk 86*b*.

One end of the trigger 86*o* is provided with a roller 86*k* which is slidable in an axial direction of the shaft 86*n*. The roller 86*k* is urged by a spring 86*j* normally in the direction indicated by an arrow P1, that is, toward the disk 86*b*. The trigger 86*i* is urged by a spring 86*m*. By doing so, the trigger 86*i* is normally urged to rotate in the direction indicated by an arrow Q in FIG. 15 about the trigger shaft 86*l*. As a result, the trigger surface 86*p* is normally urged to the outer surface of the disk 86*b*.

Figure 16:
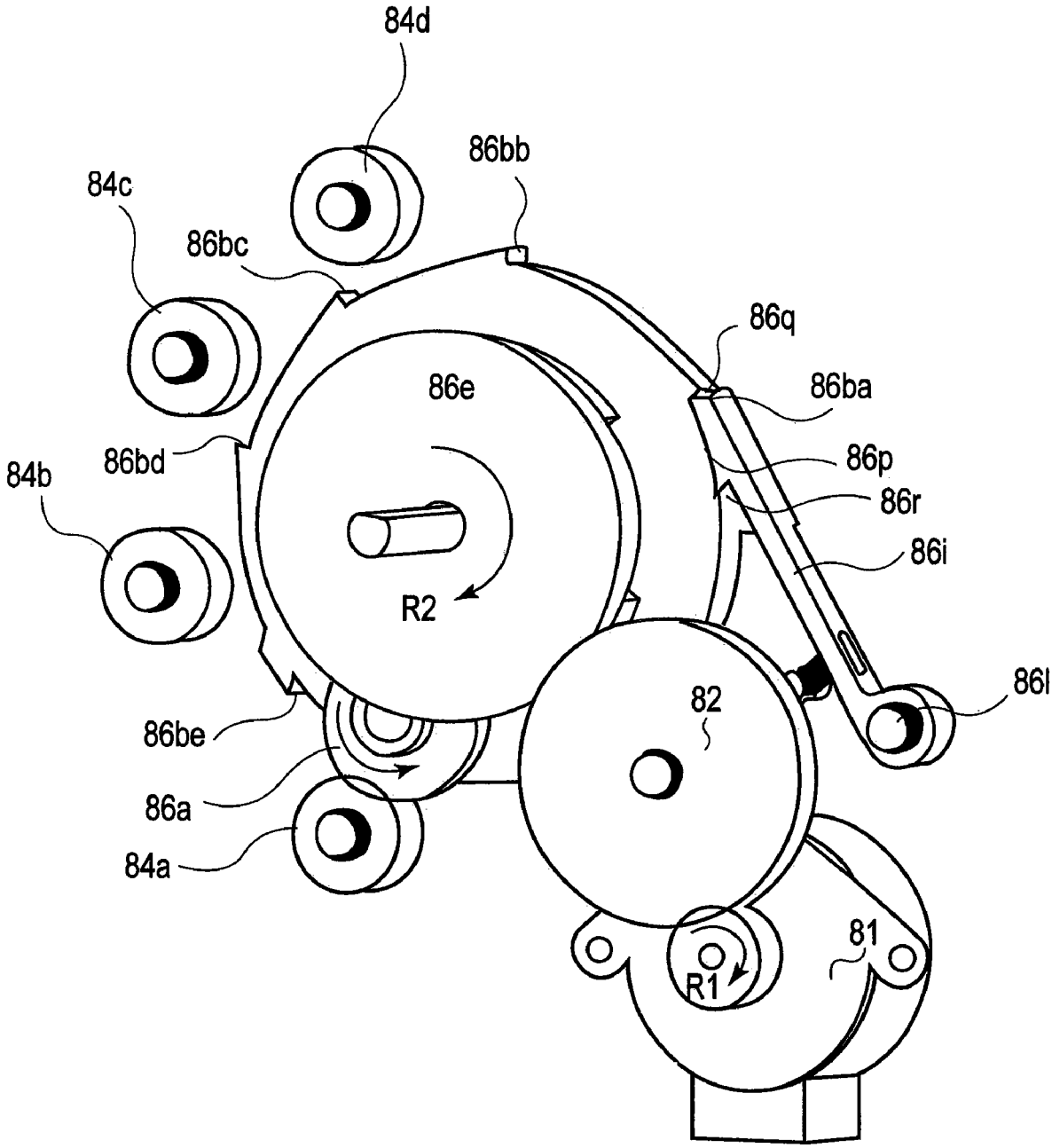
FIG. 16 illustrates the mechanical clutch according to the fourth embodiment of the present invention.

In FIG. 16, when the driving motor 81 is energized to rotate in the direction indicated by an arrow R1, the stepped gear 86*e* rotates in the direction of an arrow R2. In synchronism with rotation of the stepped gear 86*e*, the disk 86*b* rotates in the direction of an arrow R2. When one of the projections 86*ba*, 86*bb*, 86*bc* and 86*bd* provided on the outer surface of the disk 86*b* is hooked on one end 86*q* of the trigger, the disk 86*b* does not rotate, and the planetary gear 86*a* rotates. At this time, the gears 84*a*, 84*b*, 84*c*, 84*d* are disposed such that simultaneously with the rotation of the planetary gear 86*n*, either one of the gears 84*a*, 84*b*, 84*c*, 84*d* are engaged with the planetary gear 86*n* and is rotated thereby. By this arrangement, the driving force can be transmitted to the downstream part of the transmission path. The projection 86*ba*, 66*bb*, 86*bc* or 86*bd* of the disk is selected by controlling an angle of rotation (namely, the angle of rotation of the driving motor 81) from the home position of the stepped gear 86*e* which will be described hereinafter.

Figure 17:
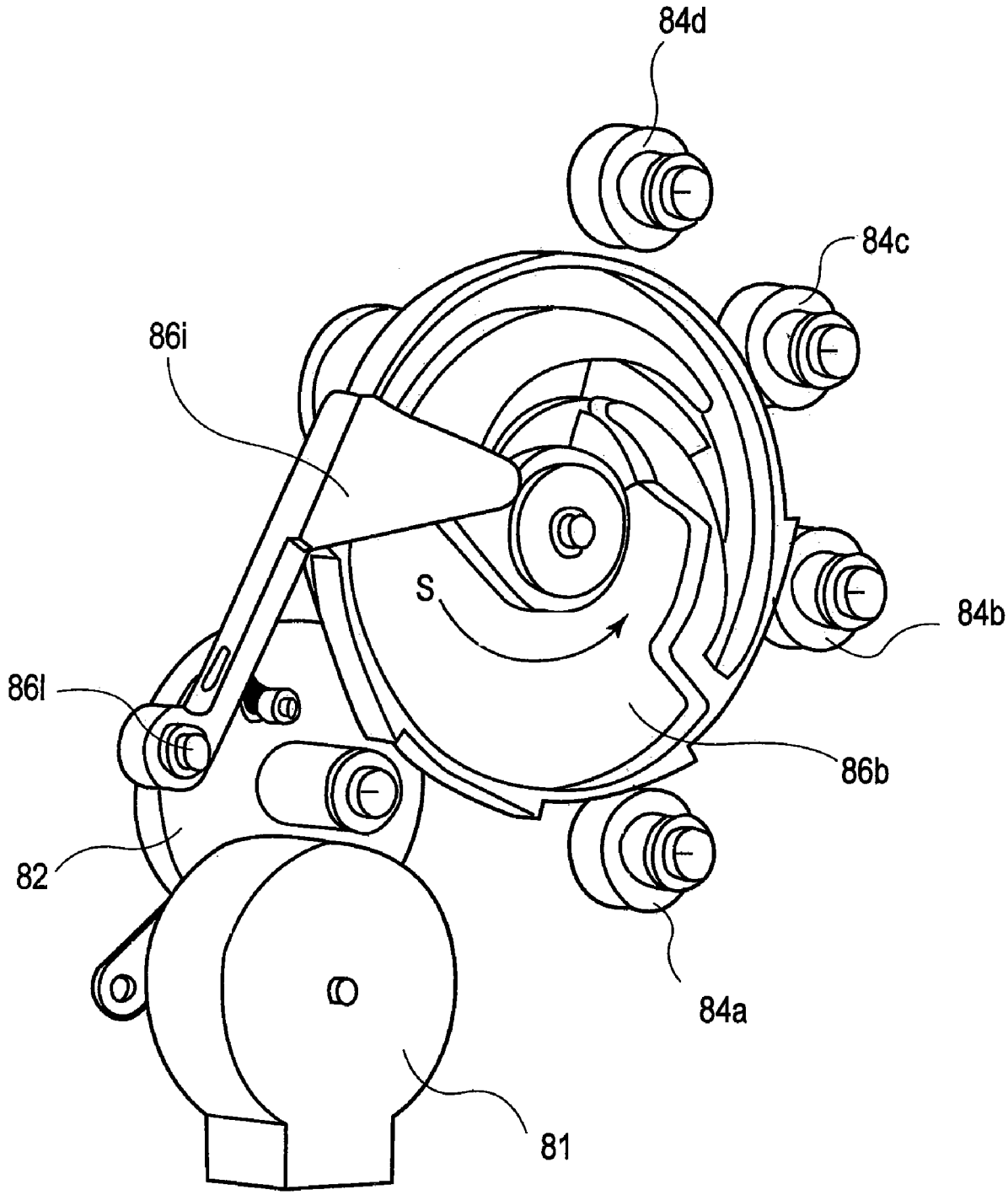
FIG. 17 illustrates the mechanical clutch according to the fourth embodiment.

When the driving motor 81 is rotated in the direction opposite from the direction indicated by an arrow R1, the disk 86*b* is rotated in the direction opposite from the direction indicated by an arrow R2. When the rotation continues, the projection 86*be* of the disk hooks on one end 86*r* of the trigger. Such a position is taken as a home position of the disk 86*b*. At this time, even if the driving motor 81 continues to rotate in the direction opposite the direction R1, the position of the disk 86*b* does not change. FIG. 17 is a view of the clutch 86 as seen from the rear side in FIG. 16.

With this state (home position), the transmission path for the driving force is selected. When the driving motor 81 is rotated in the direction of an arrow R1, the disk 86*b* rotates in the direction indicated by an arrow R2 in FIG. 16 (the direction of an arrow S in FIG. 17). With the continuation of rotation in the direction of an arrow S, the trigger 86*i* swings to the position shown in FIG. 18 against the urging force in the direction of Q provided by the spring 86*m* about the shaft 86*l*.

Figure 18:
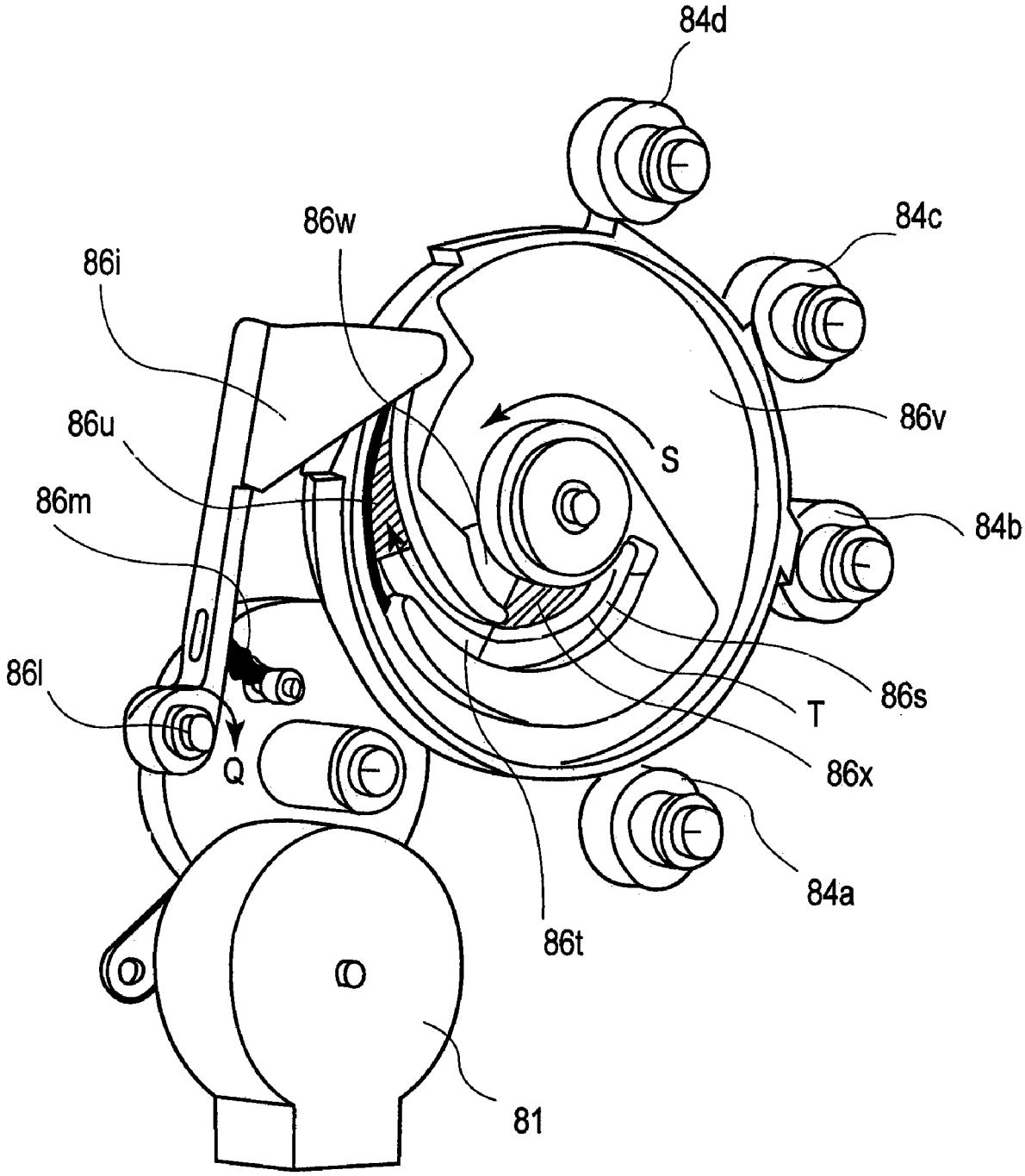
FIG. 18 illustrates the mechanical clutch according to the fourth embodiment.

This is because the roller 86*k* (FIG. 15) provided at one end 86*o* of the trigger moves along a groove (86*s*, 86*t*, 86*u*, 86*v*, 86*w*, 86*x*) provided in a back side of the disk 86*b* as shown in FIG. 18. The depths of the groove is not uniform, and the groove 86*s* and the groove 86*v* are deepest, and the grooves 86*u* and 86*l* are sharrowest. The groove 86*t* and the groove 86*w* are sloped to smoothly continues the different depth grooves.

At the home position (FIG. 17), the roller 86*k* is located in the groove 86*s*. With the rotation of the disk 86*b* in the direction of an arrow S, the roller 86*k* follows the grooved cam to advance from the groove 86*s* to the groove 86*t*, the groove 86*u* and the groove 86*v* in this order.

The disk 86*b* is rotated from the position shown in FIG. 18 in the direction opposite the direction indicated by an arrow S until one of the projections 86*ba*, 86*bb*, 86*bc* and 86*bd* hooks on one end 86*q* of the trigger, that is, until the planetary gear 86*a* is brought into meshing engagement with an intended one of the gears 84*a*, 84*b*, 84*c*, 84*d*. In this manner, the planetary gear 86*a* selects one of the gears 84*a*, 84*b*, 84*c*, 84*d* to transmits the driving force from the driving motor 81 to the selected one. By doing so, the seal 46 of the selected one of the four cartridges 7 can be wound up and removed from the opening.

The controller 61 controls the start and stop of the driving motor 81, the rotational direction of the driving motor 81 and the angle of rotation thereof. In this manner, the driving force can be transmitted to only selected one of the cartridges 7. More particularly, the driving force can be transmitted selectively only to the cartridge 7 which is set in the main assembly of the apparatus 100*a* and in which the opening 41*a* is sealed by the seal 46.

Fifth Embodiment

In the first embodiment, when there are a plurality of cartridges 7 in which the seals 46 have not yet been removed, the driving force is transmitted sequentially one by one to the winding-up members 54. However, this not inevitable, and the driving forces may be simultaneously transmitted from the driving motor 81 to the winding-up members 54. In such a case, the control is such that clutches (of the four clutches 83*a*, 83*b*, 83*c*, 83*d*) associated with the winding-up members 54 to which the driving forces are to be transmitted are simultaneously actuated. With such an arrangement, the driving motor 81 is upsized as compared with the case in which the driving force is sequentially transmission one by one as in first embodiment, for example, the overall time required for winding-up the seal 46 is shortened.

In the foregoing embodiments, the notification means provided in the cartridge 7 includes a memory unit 67, but the notification means may be a projection provided on the outer surface of the cartridge. For example, when the memory control circuit 65 detects the existence of the projection, it is discriminated that opening 41*a* is sealed by the seal 46. Then, the seal 46 is removed by the transmission of the driving force from the main assembly of the apparatus 100*a*, and after the opening 41*a* is opened, the projection is broken, and the control circuit 65 does not detect the projection, and the non-existence represents that opening 41*a* has been opened.

In the foregoing, the developer seal of the process cartridge including the photosensitive drum and the developing means is removed, as an example. However, the present invention is applicable to the cartridge not including the photosensitive drum and detachably mountable to the main assembly of the image forming apparatus, for example, a developing cartridge which contains developing means and a developer container as a unit, and in which the opening of the developer container is sealed by a developer seal.

Furthermore, the present invention is applicable to the developer container which does not include developing means and which is detachably mountable to the main assembly of the apparatus. In an image forming apparatus to which a plurality of developer containers having openings sealed by developer seals are mounted, the developer seal may be removed in the manner described above, with the same advantageous effects.

In the foregoing, in the foregoing embodiments, the sealing member has been described as being a developer seal in the form of a sheet, but the sealing member is not limited to the sheet. The sealing member may be plate-like, which is slidable in the longitudinal direction or the widthwise direction of the cartridge to open the opening 41*a*.

According to the first embodiment and the fifth embodiment, the driving force transmitting means selectively transmits the driving force to the unsealing means of the cartridge 7 when the sealing member is unsealed. The number of the motors generating the driving force to be transmitted by the driving force transmitting means may be smaller than the number of the cartridges 7 to be mounted to the main assembly of the apparatus 100*a*. The number of the motors can be smaller than the number of the cartridges 7 to be mounted to the main assembly of the apparatus 100*a*.

Sixth Embodiment

The description will be made as to a sixth embodiment of the present invention. The same reference numerals as with the first embodiment are assigned to the elements having the corresponding functions, and the detailed descriptions for such elements are omitted for simplicity.

[Structure for Separation between Photosensitive Drum and Developing Roller].

In the cartridge 7 of this embodiment, the photosensitive drum 1 and the developing roller 40 are spaced from each other before beginning of use of the cartridge 7. As shown in FIG. 3, spacer members 90, which is a part of the developing unit 4, are provided between the outside of the bearing members 48 of the developing unit 4 and the side covers 72. The spacer member 90 functions to space the photosensitive drum 1 and the developing roller 40 from each other. "Before the beginning of use of the cartridge" means "before the beginning of the use of the cartridge for image forming operation of the image forming apparatus 100 using the cartridge".

Figure 19:
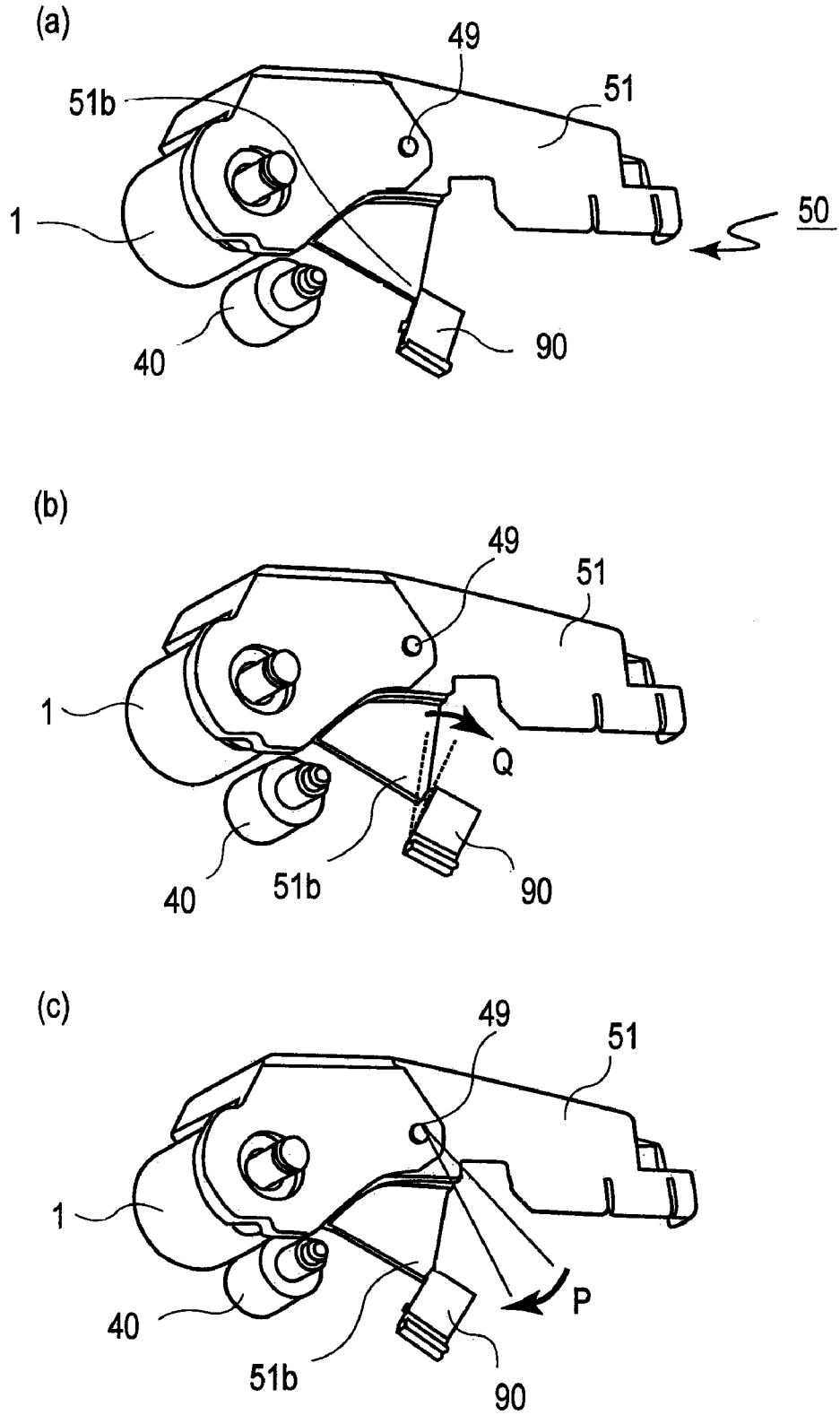
FIG. 19 is a perspective view illustrating a spacer member for spacing the photosensitive drum and the developing roller according to a sixth embodiment of the present invention.

FIG. 19 is a schematic perspective view illustrating the spacer member 90, the developing roller 40, the photosensitive drum 1 of the drum unit 50, the cleaning frame 51, and the supporting shaft 49 which provides a center of swing motion of the developing unit 4. As shown in FIG. 19, (a), at the time of shipment of the cartridge 7 from the plant, the spacer member 90 is abutted to the projection 51*b* of the cleaning frame 51.

The developing unit 4 swings about the supporting shaft 49 in the direction of an arrow P relative to the photosensitive drum unit 50 by the urging force (elastic force) of the urging spring 53. By the urging force of the spring 53, the developing roller 40 and the photosensitive drum 1 tend to contact to each other. However, before they are contacted to each other, the spacer member 90 and the projection 51*b* are abutted to each other. Thus, the swing motion of the developing unit 4 is limited. And, as shown in FIG. 19, (a), the developing roller 40 and the photosensitive drum 1 are kept out of contact from each other. The spacer member 90 takes a spacing position for spacing the photosensitive drum 1 and the developing roller 40 from each other.

As shown in FIG. 19, (b), the spacer member 90 has a configuration (plate-like, for example) for permitting deformation and/or displacement in the direction of an arrow Q. When the spacer member 90 temporarily displaces in the direction indicated by an arrow Q toward the contact position, the developing unit 4 in which the swing is limited in FIG. 19, (a) starts to swing relative to the photosensitive drum unit 50 by the urging force (elastic force) of the urging spring 53. And, as shown in FIG. 19, (c), the swing of the developing unit 4 stops at the position where the developing roller 40 and the photosensitive drum 1 are contacted to each other. At this time, the spacer member 90 takes a contact position where it permits contact between the photosensitive drum 1 and the developing roller 40.

Therefore, by moving the spacer member 90 as shown in FIG. 19, (c) upon the beginning of use of the cartridge 7, the opening 41*a* of the cartridge 7 opens to enable the cartridge 7 operable for image formation.

[Relation Between Spacer Member and Winding-Up of Toner Seal]

In the cartridge 7 of this embodiment, simultaneously with winding-up of the seal 46, the spacer member 90 moves to permit contact between the photosensitive drum 1 and the developing roller 40 upon the beginning of the use.

Figure 20:
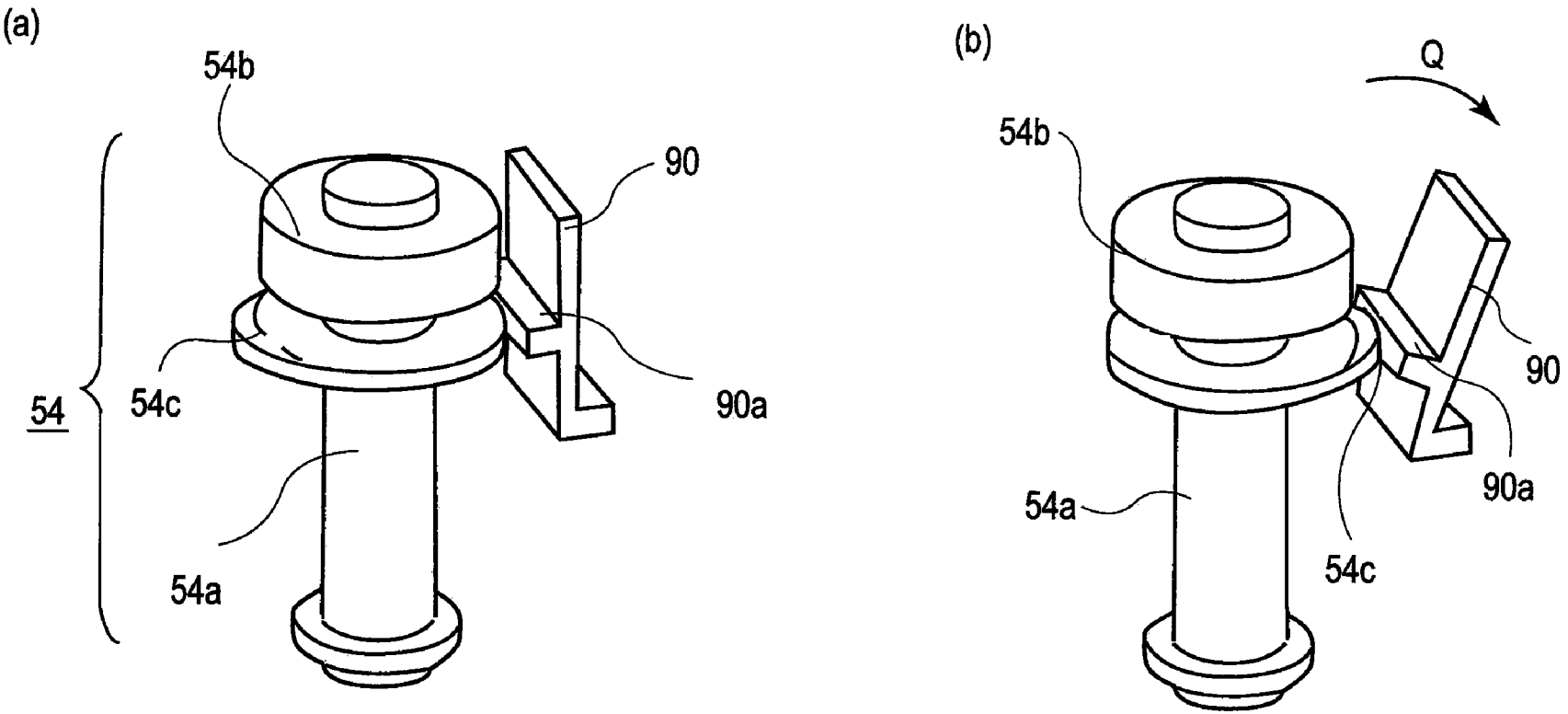
FIG. 20 is a perspective view illustrating structures of a winding-up member and a spacer member according to the sixth embodiment of the present invention.

As shown in FIG. 20, (a), the winding-up member 54 of this embodiment is provided with a cam portion 54*c* which a part of the rib is formed into. The cam portion 54*c* is disposed at a position opposed to the rib 90*a* provided on the spacer member 90 described hereinbefore. Upon the shipment of the cartridge 7 from the plant, the winding-up member 54 of the phase is adjusted so that cam radius of the portion facing to the spacer member 90 does not deform the spacer member 90. The user mounts the cartridge 7 to the main assembly of the apparatus 100*a*. An electric signal is produced by a controller (unshown) provided in the main assembly of the apparatus 100*a*. Then, a rotational driving force is transmitted to the winding-up member 54 from the main assembly of the apparatus 100*a* to rotate the winding-up member 54. As shown in FIG. 20, (b), by the rotation, the cam portion 54*c* pushes the spacer member 90 to displace the spacer member 90. By this, as shown in FIG. 19, (a)-(c), the spacer member 90 displaces from the separation position to the contact position. The spacer member 90 releases the spacing prevention between the developing roller 40 and the photosensitive drum 1. Then, the developing roller 40 and the photosensitive drum 1 are brought into contact to each other by the elastic force of the spring 53. Thus, with a simple structure, the spaced photosensitive drum 1 and the process means (developing roller 40) are automatically brought into contact to each other before the beginning of use of the cartridge 7 without the necessity for the operator to perform an operation for the spacing prevention release.

In this manner, upon start of use of the cartridge 7, when the seal 46 is removed, in interrelation with rotation of the winding-up member 54, the spacing prevention between the developing roller 40 and the photosensitive drum 1 can be released. Therefore, the user is not required to manipulate for unsealing the opening 41*a*, for removal of the spacer member which spaces the developing roller 10 and the photosensitive drum 1 from each other, or the like. Accordingly, the usability can be improved.

And, the photosensitive drum 1 and the developing roller 40 can be kept spaced until the start of use of the cartridge 7 without imparting a cumbersome operation to the user. Upon the start of use of the cartridge 7, the separation and the photosensitive drum 1 can be brought into contact to each other, automatically.

Figure 21:
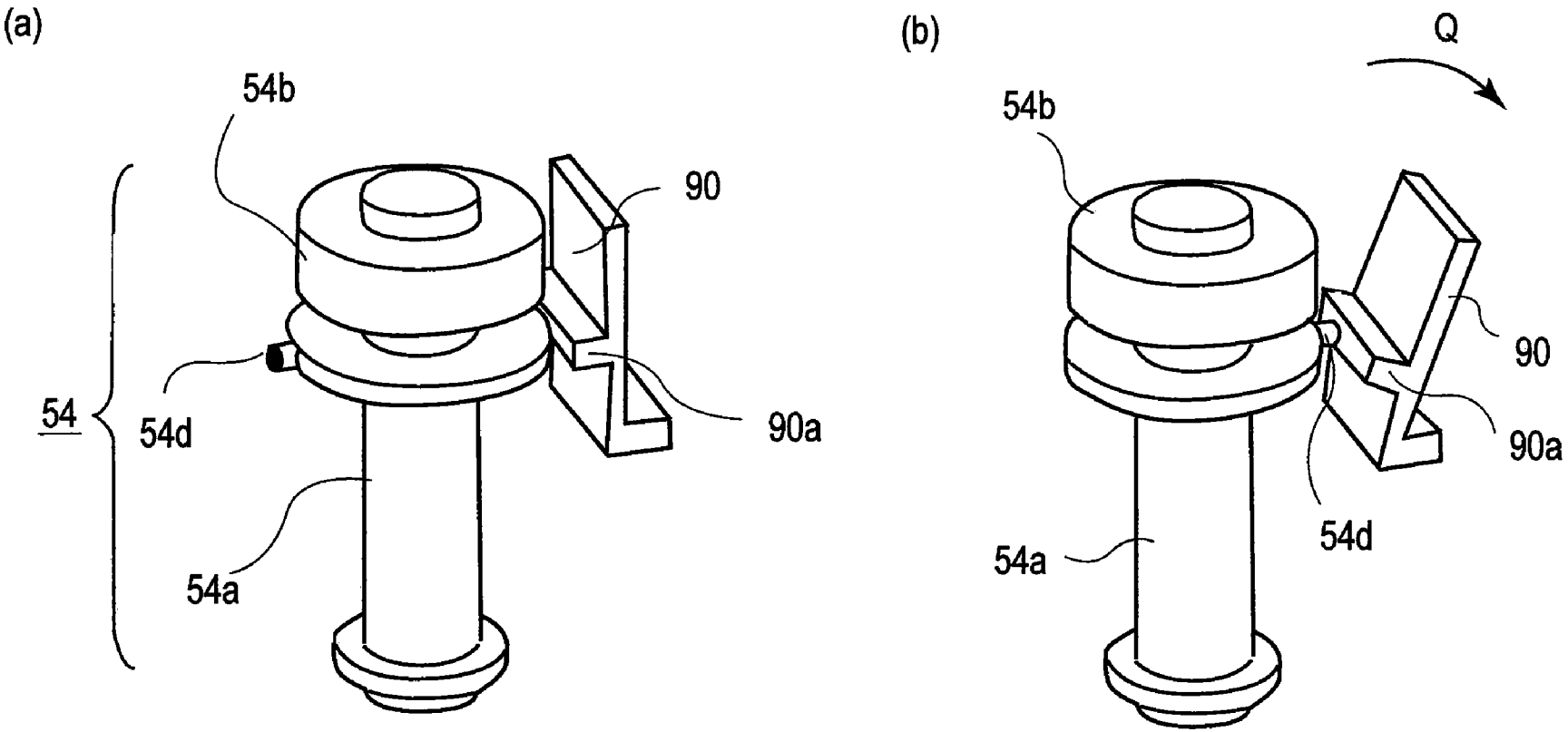
FIG. 21 is a perspective view illustrating the winding-up member a sixth embodiment of the present invention.

A part of the winding-up member 54 is a cam profile portion. However, this is not inevitable, and as shown in FIG. 21, (a) and (b), the part thereof may be in the form of a projection 54*d*. The projection 54*d* functions to deform the spacer member 90 in the direction indicated by an arrow Q. By doing so, the same advantageous effects can be provided.

In the embodiments in which the spacer member 90 is deformed to displace it in effect, the material of the spacer member is plastic resin material, rubber or the like having an elasticity.

The basic structures of the apparatus of this embodiment have been described as being substantially the same as those in first embodiment, but they may be the same as those in the second to fifth embodiments.

Seventh Embodiment

Referring to FIG. 11, the description will be made as to the seventh embodiment. The same reference numerals as with the sixth embodiment are assigned to the elements having the corresponding functions, and the detailed descriptions for such elements are omitted for simplicity.

Figure 22:
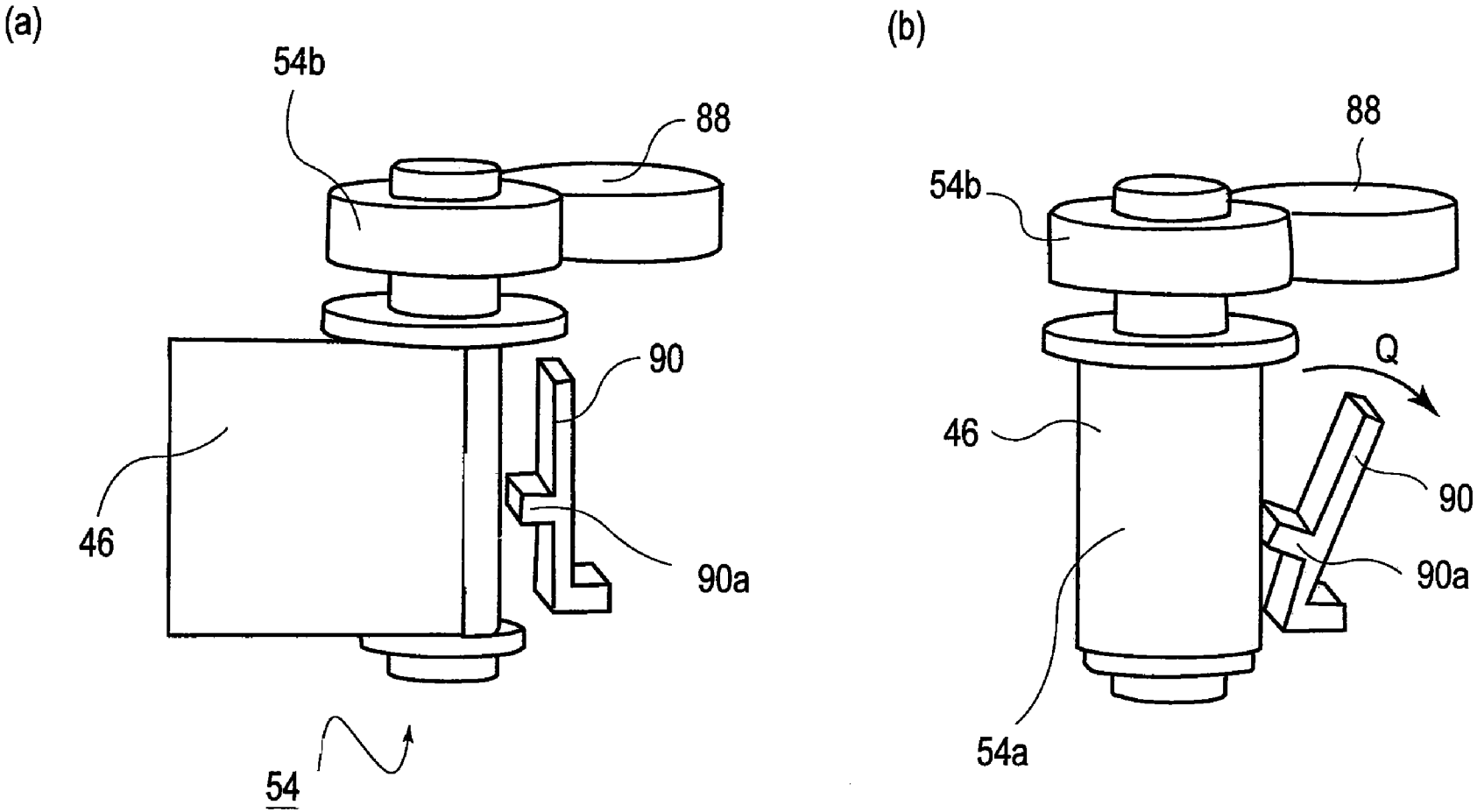
FIG. 22 is a perspective view illustrating a winding-up member according to a seventh embodiment of the present invention.

FIG. 22, (a) illustrates a winding-up member 54 before it winds the seal 46 up, the seal 46, the spacer member 90, and a driving gear 88 provided in the main assembly of the apparatus 100*a* to transmit the driving force to the winding-up member 54.

The rib 90*a* of the spacer member 90 is disposed at a position opposing the winding-up portion 54*a* on which the seal 46 is wound up. FIG. 22, (b) shows the state in which the winding-up member 54 has been rotated until the seal 46 has been wound up. As will be understood, the overall shaft diameter of the winding-up member 54 has been increased by the amount corresponding to the winding-up of the seal 46. The spacer member 90 is pushed by the diameter increased portion of the winding-up member 54 and moves in the direction of the arrow Q. This is utilized to release the spacing prevention between the developing roller 40 and the photosensitive drum 1. Therefore, the photosensitive drum 1 and the developing roller 40 are brought into contact to each other by the elastic force of the spring 53.

In the sixth embodiment, the spacing prevention release between the developing roller 40 and the photosensitive drum 1 occurs upon at least one-full rotation of the winding-up member 54. However, in this embodiment, the spacing prevention can be released upon a plurality of full-rotations of the winding-up member 54.

This means that by the release of the spacing prevention between the developing roller 40 and the photosensitive drum 1, the developing unit 4 swings relative to the photosensitive drum unit 50, in interrelation with which the winding-up member 54 which is a part of the developing unit 4 swings. Therefore, there is a possibility that engagement with the driving gear 88 of the main assembly of the apparatus 100*a* for transmitting the driving force to the gear portion 54*b* of winding-up member 54 is disturbed. This embodiment is effective for the countermeasurement against this possibility.

More particularly, the spacer member 90 located at the spacing position displaces to the contact position only after the toner seal 46 is sufficiency wound up by rotating a plurality of times the winding-up member 54 so that opening 41*a* is opened, in this embodiment. This accomplishes the release of the spacing prevention between the developing roller 40 and the photosensitive drum 1. Therefore, a longer time is assured for the engagement between the winding-up member 54 and the driving gear 88. For this reason, the seal 46 can be assuredly wound up.

The spacer member 90 is deformable in the direction indicated by an arrow Q, but it may be a spacer member 90 which is simply movable in the direction of the arrow Q without deformation.

Eighth Embodiment

Figure 23:
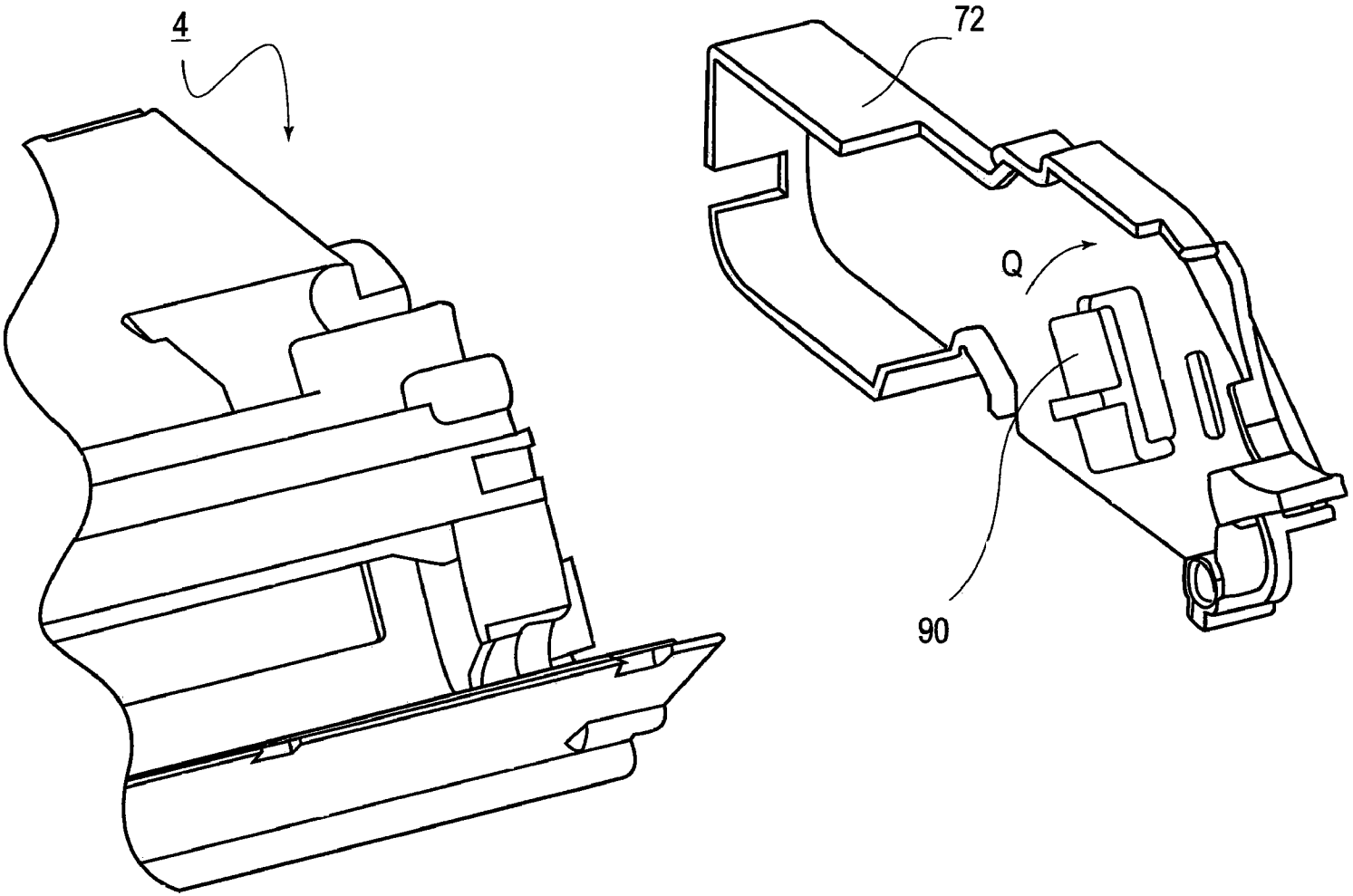
FIG. 23 is a perspective view illustrating a side cover of a process cartridge according to an eighth embodiment.

Referring to FIG. 23, the description will be made as to the eighth embodiment of the present invention. The same reference numerals as with the sixth embodiment are assigned to the elements having the corresponding functions, and the detailed descriptions for such elements are omitted for simplicity.

FIG. 23 shows an inside of a side cover (cartridge cover) of the cartridge 7. The cover 72 of this embodiment has an integral spacer member 90 which has the structure described in the foregoing embodiment. The spacer member 90, as shown in the Figure, is deformable in the direction of an arrow Q. The cover 72 covers a side surface of the cartridge 7.

According to this embodiment, no additional spacer member is required, and therefore, the total the number of parts of the cartridge 7 can be reduced. This can save the cost and improve the assembling property.

Ninth Embodiment

Figure 24:
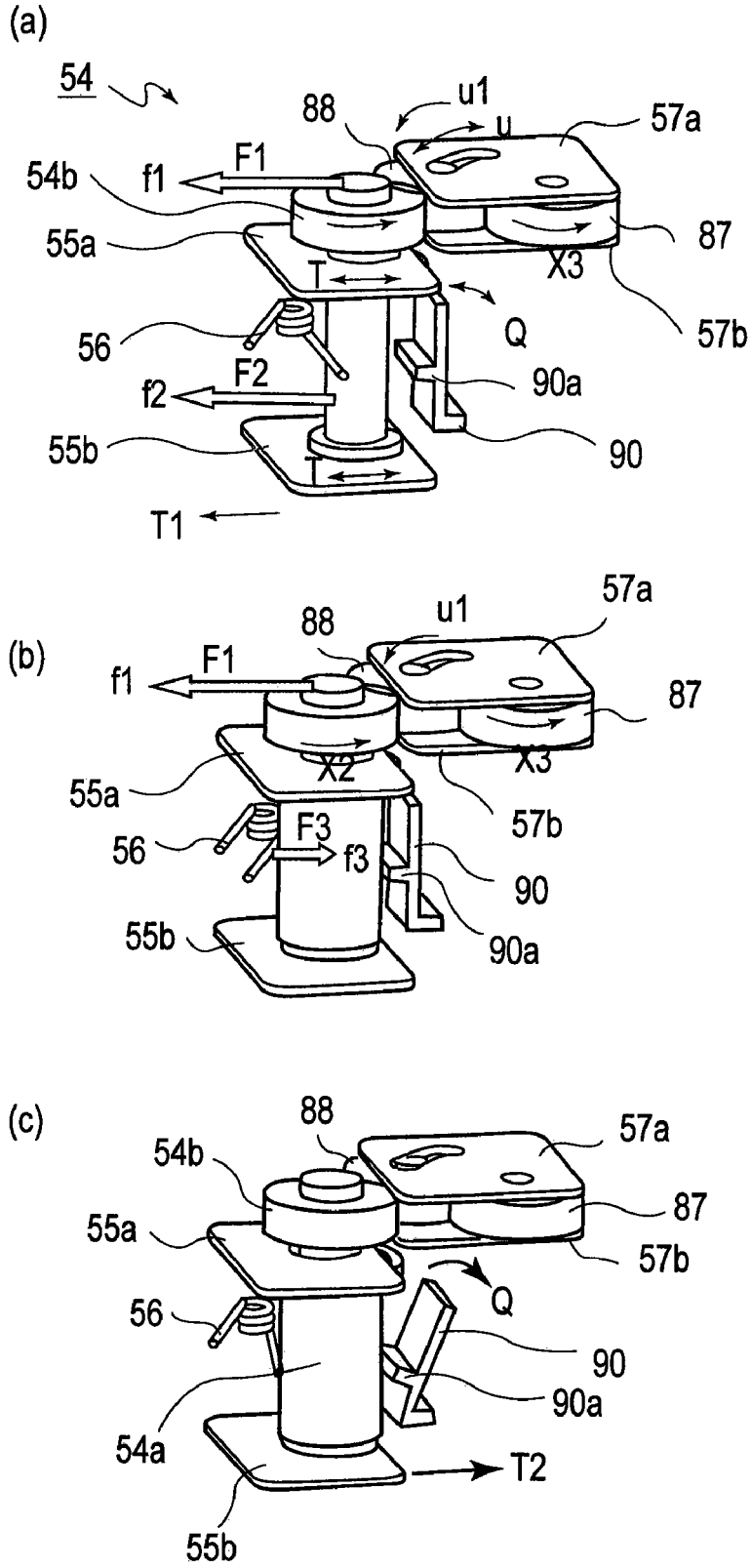
FIG. 24 is a perspective view illustrating a structure around a winding-up member according to a ninth embodiment.

Referring to FIG. 24, the apparatus according to the ninth embodiment of the present invention will be described. The same reference numerals as with the sixth embodiment are assigned to the elements having the corresponding functions, and the detailed descriptions for such elements are omitted for simplicity.

In this embodiment, after the stop of rotation of the winding-up member 54, the spacer member 90 deforms and/or displaces from the spacing position to the contact position. This accomplishes the release of the spacing prevention between the developing roller 40 and the photosensitive drum 1.

FIG. 24, (a) shows winding of the seal 46 and the displacement of the spacer member 90 in this embodiment. There are provided in this embodiment a winding-up member 54 which is a part of the developing unit 4 and a spacer member 90 which is partly deformable in the direction of an arrow Q. Also provided is a bearing members 55 (55*a*, 55*b*) for supporting the winding-up member 54. The bearing member 55 has a hole elongated in the direction of an arrow T. In addition, there is provided a twisted urging spring 56. The main assembly of the apparatus 100*a* is provided with a driving gear 88 which is swingable in the direction indicated by an arrow u. An input gear 87 functions too transmit the driving force to the driving gear 88 and to swing the driving gear 88. Bearing members 57 (57*a*, 57*b*) supports the driving gear 88 for swing motion about the rotation shaft of the input gear 87.

In FIG. 24, (a), when the input gear 87 rotates in the direction of an arrow X3, the driving gear 88 swings in the direction of the arrow u1. The gear 82 transmits the driving force for rotating the gear portion 54*b* of the winding-up member 54 in the direction of an arrow X2. By this arrangement, the seal 46 is wound up on the winding-up member 54. In this manner, the driving force is transmitted to the winding-up member 54, and during the seal 46 being wound, the winding-up member 54 receives an engaging force F1 in the direction indicated by an arrow f1 in the Figure from the driving gear 88. In addition, a peeling force F2 for tearing and winding the seal 46 applies in the direction indicated by an arrow f2.

Therefore, the winding-up member 54 rotates while being kept abutted to an inside of an elongated hole of the bearing member 55 (55*a*, 55*b*) in a direction of an arrow T1. When the seal 46 has not yet been wound, the winding-up member 54 and the urging spring 56 are not contacted to each other, as shown in FIG. 24, (a). The rib 90*a* of the spacer member 90 is not contacted to the winding-up member 54, and therefore, the photosensitive drum 1 and the developing roller 40 are spaced from each other.

FIG. 24, (b) shows the winding-up member 54 in the state that seal 46 has been completely wound up, and the winding-up member 54 still receiving the force from the driving gear 88.

In this state, the shaft diameter is large since it winds the seal 46. Since the seal 46 has been wound up, no peeling force F2 for tearing the seal 46 does not apply.

The winding-up member 54 now having an overall shaft diameter having been increased corresponding to the winding-up of the seal 46 presses against one end of the urging spring 56 to deform the spring 56 as shown in the Figure. For this reason, the winding-up member 54 receives an urging force F3 from the spring 56 in the direction of an arrow f3.

However, the winding-up member 54 receives the engaging force F1 from the driving gear 88 in the direction of an arrow f1, wherein f1>F3. Therefore, the position of the winding-up member 54 does not change. The winding-up member 54 and the spacer member 90 are out of contact from each other. Therefore, the spacer member 90 remains at the spacing position.

From this state, the rotation of the input gear 87 is stopped. The winding-up member 54 now released from the engaging force F1 from the driving gear 88 receives only the urging force F3 from the spring 56 in the direction of an arrow f3. As a result, as shown in FIG. 13, (c), the winding-up member 54 movements in the direction of an arrow T2. With this movement of the winding-up member 54, the seal 46 wound around the winding-up member 54 pushes the rib 90*a* of the spacer member 90. This deforms the spacer member 90, thus displacing the spacer member 90 in effect. Thereafter, similarly to the embodiment, with the deformation of the spacer member 90, the release of the spacing prevention is carried out between the developing roller 40 and the photosensitive drum 1.

Thus, the rotation of the winding-up member 54 is stopped only after the opening 41*a* of the developer container 41 is opened by complete winding-up of the toner seal 46. Thereafter, the spacer member 90 is displaced to release the prevention of contact between the photosensitive drum 1 and the developing roller 40. Therefore, the developing unit 4 does not swing relative to the drum unit 50 when the winding-up member 54 is rotating. Erroneous driving force transmission between the gear portion 54*b* of the winding-up member 54 and the driving gear 88 such as tooth skipping or the like can be suppressed so that removal of the seal 46 can be assured. Moreover, the release of the spacing prevention is assured between the developing roller 40 and the photosensitive drum 1.

Tenth Embodiment

In the above-described embodiments, the process means spaced from the photosensitive drum by the spacer member 90 is a developing roller 40 as an example. However, the process means is not inevitably a developing roller. For example, the present invention is applicable to the process means to be contacted to the photosensitive drum such as a charging roller (charging means) or the like. The similar advantageous effects are provided in such a case.

The process cartridge is a cartridge including a photosensitive drum and at least one of process means. The process means may be charging means, developing means and cleaning means, for example. The electrophotographic image forming apparatus is an apparatus which forms an image on a recording material through an electrophotographic image formation type process Examples of the electrophotographic image forming apparatus include an electrophotographic copying machine, an electrophotographic printer (a laser beam printer, LED printer or the like), a facsimile machine, and a word processor or the like.

According to the sixth embodiment to the tenth embodiments, the electrophotographic photosensitive drum and the process means which are kept out of contact from each other can be brought into contact to each other automatically.

According to the sixth embodiment to the tenth embodiments, the electrophotographic photosensitive drum and the process means which are kept out of contact from each other can be brought into contact to each other before start of use of the process cartridge without the necessity for the operator to do a particular operation for release of the spacing prevention.

According to the sixth embodiment to the tenth embodiments, the electrophotographic photosensitive drum and the process means which are kept out of contact from each other can be brought into contact to each other in interrelation with the unsealing operation of the developer supply opening.

According to the sixth embodiment to the tenth embodiment, the electrophotographic photosensitive drum and the process means which are kept out of contact from each other can be brought into contact to each other, with a simple structure.

By this, the photosensitive drum and the process means can be kept out of contact from each other until the start of use of the process cartridge. The electrophotographic photosensitive drum and the process means kept out of contact from each other can be automatically contacted upon the start of use of the process cartridge.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 198915/2004 and 214215/2004 filed Jul. 6, 2004 and Jul. 22, 2004, respectively, which are hereby incorporated by reference.

What is claimed is:

1. An electrophotographic image forming apparatus for forming an image on a recording material, said apparatus comprising:

(a) a plurality of mounting portions that detachably mount cartridges, respectively, said cartridges each including:
- a developing roller that develops an electrostatic latent image formed on an electrophotographic photosensitive drum;
- a developer accommodating portion that accommodates a developer for use by the developing roller to develop the electrostatic latent image,
- a developer supply opening that supplies the developer to the developing roller from the developer accommodating portion;
- a sealing member that unsealably seals the developer supply opening; and
- an unsealing device that unseals the developer supply opening by removing the sealing member from the developer supply opening;

(b) a motor; and (c) a driving force transmitting device that transmits a driving force selectively to one of the unsealing devices from said motor to unseal selectively one of the developer supply openings, said driving force transmitting device including:
- a gear, rotatable about an axis, that receives the driving force from said motor;
- a rotatable member rotatable about said axis;
- a planetary gear, rotatable relative to said rotatable member and revolvable about said axis by rotation of said rotatable member, that selectively transmits the driving force from said gear to one of said unsealing devices;
- a frictional portion that transmits the driving force from said gear to said rotatable member by a frictional force produced by being pressed between said rotatable member and said gear;
- a plurality of engaging portions, provided on said rotatable member, that stop said rotatable member at a plurality of positions where said planetary gear is capable of transmitting the driving force to the plurality of unsealing devices, respectively; and a trigger, engageable with one of the engaging portions, that stops rotation of said rotatable member against the frictional force.

2. An apparatus according to claim 1, further comprising a detecting device that detects that the developer supply opening of each of the cartridges mounted to said mounting portions is sealed by the sealing member, wherein said driving force transmitting device transmits the driving force to the unsealing device of the cartridge for which said detecting means detects that the developer supply opening is sealed to act on the unsealing means.

3. An apparatus according to any one of claims 1 and 2, wherein said motor is the only motor for applying a driving force to the unsealing devices, and said driving force transmitting device transmits the driving force sequentially one by one to the unsealing devices to sequentially unseal the sealing members.

4. An apparatus according to claim 1, wherein said gear is a stepped gear having a first gear for receiving the driving force from said motor and a second gear for transmitting the driving force to said planetary gear.

5. An apparatus according to claim 1, wherein said frictional portion comprises a felt member.

* * * * *